US012167782B2

(12) United States Patent
Ma

(10) Patent No.: US 12,167,782 B2
(45) Date of Patent: Dec. 17, 2024

(54) UMBRELLA WITH HUB REINFORCED TILT COUPLING

(71) Applicant: Qingdao Activa Shade Inc., Qingdao (CN)

(72) Inventor: Zhun-An Ma, Ningbo (CN)

(73) Assignee: Qingdao Activa Shade Inc., Qingdao (CN)

( * ) Notice: Subject to any disclaimer, the term of this patent is extended or adjusted under 35 U.S.C. 154(b) by 427 days.

(21) Appl. No.: 17/452,208

(22) Filed: Oct. 25, 2021

(65) Prior Publication Data

US 2022/0125169 A1 Apr. 28, 2022

Related U.S. Application Data

(60) Provisional application No. 63/105,707, filed on Oct. 26, 2020.

(51) Int. Cl.
*A45B 17/00* (2006.01)

(52) U.S. Cl.
CPC ..... *A45B 17/00* (2013.01)

(58) Field of Classification Search
CPC ..... A45B 17/00
See application file for complete search history.

(56) References Cited

U.S. PATENT DOCUMENTS

| | | | |
|---|---|---|---|
| 593,726 | A | 11/1897 | Nicholls |
| 835,306 | A | 11/1906 | Mangelsdorf |
| 878,270 | A | 2/1908 | Blake et al. |
| 956,657 | A | 5/1910 | Wetteroth |
| 957,528 | A | 5/1910 | Wetteroth |
| D45,227 | S | 2/1914 | Glauber |
| 1,136,887 | A | 4/1915 | Penn |
| 1,235,296 | A | 7/1917 | Dillingham |
| 1,243,594 | A | 10/1917 | Dillingham |
| 1,255,627 | A | 2/1918 | Morrow et al. |
| 1,268,354 | A | 6/1918 | Howard |
| 1,801,913 | A | 4/1931 | Frederick |
| 1,881,990 | A | 10/1932 | Zitzer |

(Continued)

FOREIGN PATENT DOCUMENTS

| | | |
|---|---|---|
| AT | 128258 | 5/1932 |
| BG | 6965-0001 | 4/2009 |

(Continued)

OTHER PUBLICATIONS

Operation Manual Easy Sun Parasol Sunshade (Issue: Jul. 2004) pp. 1-17.

(Continued)

*Primary Examiner* — Noah Chandler Hawk
(74) *Attorney, Agent, or Firm* — Knobbe, Martens, Olson & Bear, LLP

(57) ABSTRACT

A tilting umbrella with a canopy assembly including a lower hub, an upright pole and a tilt mechanism. The tilt mechanism includes an actuator coupled with a lower pole portion and adjusts an upper pole portion from an untitled configuration to a second configuration. The lower hub is disposed at a tilt location between the upper pole portion and the lower pole portion. The lower hub can include an outer portion disposed over the upper pole portion that is pivotable relative to an inner portion disposed over the lower pole portion in the second configuration.

28 Claims, 22 Drawing Sheets

(56) References Cited

U.S. PATENT DOCUMENTS

D90,772 S 9/1933 Kasch
1,972,653 A 9/1934 Hart
2,013,192 A 9/1935 Sidney
2,223,253 A 11/1940 Hamilton
D127,735 S 6/1941 Dreyfuss
2,447,972 A 8/1948 Weinert
2,462,560 A 2/1949 Schmidt
2,475,406 A 7/1949 Russell
D162,678 S 3/1951 Muller-Munk
D167,619 S 9/1952 Coran
2,661,012 A 12/1953 Militano
2,719,688 A 10/1955 Seifert
2,721,569 A 10/1955 Militano
2,745,421 A 5/1956 Russell
2,762,383 A 9/1956 Wittman
2,819,725 A 1/1958 Deisenroth et al.
D183,609 S 9/1958 Higgins
2,932,047 A 4/1960 Johnston
2,937,653 A 5/1960 Danciart et al.
D190,597 S 6/1961 Nelson
3,120,238 A 2/1964 Glatz
3,129,715 A 4/1964 Militano
3,142,307 A * 7/1964 Danciart ..... A45B 17/00 403/108
3,145,720 A 8/1964 Torii
3,171,418 A 3/1965 Meyer
3,175,568 A 3/1965 Kafka
3,177,882 A 4/1965 Militano
3,177,883 A 4/1965 Militano
3,253,310 A 5/1966 McCarthy
3,279,835 A 10/1966 Krohm
3,311,119 A * 3/1967 Pearlstine ..... A45B 17/00 135/20.3
3,347,575 A 10/1967 Morris
3,395,717 A 8/1968 Weber
3,424,180 A 1/1969 Giancarlo
3,457,931 A 7/1969 Yoshio
3,521,651 A * 7/1970 Pearlstine ..... A45B 17/00 403/103
D221,039 S 6/1971 Zimmerman
3,683,948 A 8/1972 Cohen
3,802,452 A 4/1974 Weber
3,856,032 A 12/1974 Schafer
D234,729 S 4/1975 Weber et al.
D265,498 S 7/1982 Paul
4,368,749 A 1/1983 Lindler et al.
4,385,849 A 5/1983 Crain
D276,838 S 12/1984 Hill et al.
4,586,525 A 5/1986 Glatz et al.
4,622,987 A 11/1986 Redl et al.
4,674,523 A 6/1987 Glatz
4,807,655 A 2/1989 Robertson
4,811,670 A 3/1989 Kolvites et al.
4,829,857 A 5/1989 Jones
4,878,509 A 11/1989 Tung
4,911,573 A 3/1990 Pietro
4,993,445 A 2/1991 Dubinsky
5,002,081 A 3/1991 Stromeyer
5,020,557 A 6/1991 Apple
5,029,596 A 7/1991 Tung
5,050,627 A 9/1991 Hengtzu
5,174,319 A 12/1992 Chou et al.
5,186,197 A 2/1993 Lavine
5,284,171 A 2/1994 Liu
D344,786 S 3/1994 Short et al.
5,333,824 A 8/1994 Dubinsky
5,349,975 A 9/1994 Valdner
5,355,903 A 10/1994 Haddad et al.
5,357,994 A 10/1994 Chung
D366,826 S 2/1996 Heithaus
5,499,644 A 3/1996 Geniele
D372,854 S 8/1996 Jimenez
5,584,564 A 12/1996 Phyle
5,588,455 A 12/1996 Kuo
5,611,364 A 3/1997 Woods et al.
5,615,698 A 4/1997 Ko
5,617,888 A 4/1997 Wu
5,640,984 A 6/1997 Dubunsky
5,651,732 A 7/1997 Dufour
5,655,557 A 8/1997 Martin
5,740,823 A 4/1998 Lin et al.
5,740,824 A 4/1998 Tang
5,749,386 A 5/1998 Samuel, Jr.
5,779,386 A 7/1998 Eichhorn
5,785,069 A 7/1998 Glatz
D397,054 S 8/1998 Brantley et al.
D398,443 S 9/1998 Bolle
5,809,734 A 9/1998 Turner
5,816,276 A 10/1998 Seidel et al.
D400,777 S 11/1998 Carsello
5,836,328 A 11/1998 Lee
5,871,024 A 2/1999 Vanderminden, Sr.
5,884,645 A 3/1999 Chen et al.
D408,621 S 4/1999 Kuo
5,899,210 A 5/1999 Letherby et al.
D410,862 S 6/1999 Milhov
5,921,115 A 7/1999 Winner
5,937,882 A 8/1999 Harbaugh
6,014,980 A 1/2000 Glatz
D424,799 S 5/2000 Lai
6,082,383 A 7/2000 Wilson
6,129,101 A 10/2000 Dubinsky
D434,215 S 11/2000 Lin
D434,476 S 11/2000 Meda
6,145,523 A 11/2000 Lo
6,152,156 A 11/2000 Tung
D434,556 S 12/2000 Lin
6,192,907 B1 2/2001 Wu
6,216,712 B1 4/2001 Lin et al.
6,220,261 B1 4/2001 Glatz
6,230,728 B1 5/2001 Reese
6,247,483 B1 6/2001 Rung
6,305,394 B1 10/2001 Reese
6,311,705 B1 11/2001 Ma
6,311,707 B1 11/2001 Wu et al.
6,314,976 B1 11/2001 Clarke
6,345,639 B2 2/2002 Rousselle et al.
6,371,141 B1 4/2002 Lin et al.
6,371,686 B1 4/2002 Wu
6,374,840 B1 4/2002 Ma
6,386,214 B1 5/2002 Clarke
6,386,215 B1 5/2002 Chang
D458,904 S 6/2002 Montena
6,412,506 B1 7/2002 Reese
6,422,251 B1 7/2002 Tseng
6,446,650 B1 9/2002 Ma
6,478,037 B2 11/2002 Tung
6,516,820 B1 * 2/2003 Earnshaw ..... A45B 25/06 135/20.1
6,571,813 B2 6/2003 Lin et al.
6,575,182 B2 6/2003 Tung
6,575,183 B2 6/2003 Tung
D477,458 S 7/2003 Goldwitz
6,588,438 B1 7/2003 Steiner
6,595,713 B1 7/2003 Wilson
D478,416 S 8/2003 Clarke
6,619,306 B2 9/2003 Ma
6,662,815 B2 12/2003 Tung
D484,680 S 1/2004 You
D489,169 S 5/2004 You
D489,170 S 5/2004 You
D489,967 S 5/2004 Funk
6,732,753 B2 5/2004 Chang
6,758,229 B2 7/2004 Wang
D497,478 S 10/2004 Clarke
D497,479 S 10/2004 Yu
6,810,895 B2 11/2004 Lin et al.
6,837,255 B2 1/2005 Bunch et al.
6,848,459 B2 2/2005 Ma
6,851,823 B2 2/2005 Bilotti
D503,035 S 3/2005 Ko
6,889,699 B2 5/2005 Clarke
6,920,887 B2 7/2005 Lo
6,941,960 B2 9/2005 Huang

(56) References Cited

U.S. PATENT DOCUMENTS

| | | | | |
|---|---|---|---|---|
| D515,803 | S | 2/2006 | You | |
| 7,000,624 | B2 | 2/2006 | Chang | |
| D525,721 | S | 7/2006 | Landes | |
| 7,082,953 | B2 | 8/2006 | Liu | |
| 7,089,950 | B2 | 8/2006 | Lin | |
| D532,947 | S | 11/2006 | Muscarella | |
| 7,182,713 | B2 | 2/2007 | Wang | |
| D539,632 | S | 4/2007 | Ma | |
| 7,255,118 | B2 | 8/2007 | Ma | |
| 7,281,542 | B2 | 10/2007 | Ko | |
| D555,349 | S | 11/2007 | You | |
| 7,293,573 | B2 | 11/2007 | Clarke | |
| D558,444 | S | 1/2008 | Ma | |
| 7,318,444 | B2 | 1/2008 | Clakre | |
| 7,328,715 | B2 | 2/2008 | Neubardt | |
| 7,412,985 | B2 | 8/2008 | Ma | |
| D586,549 | S | 2/2009 | Hermanson et al. | |
| D586,550 | S | 2/2009 | Hermanson et al. | |
| D587,448 | S | 3/2009 | You | |
| 7,546,845 | B2 | 6/2009 | Prusmack | |
| D600,439 | S | 9/2009 | Zonsius | |
| 7,600,734 | B2 | 10/2009 | Clarke | |
| 7,665,477 | B1 | 2/2010 | Hathaway | |
| 7,686,024 | B1 | 3/2010 | Lai | |
| 7,703,464 | B2 | 4/2010 | Ma | |
| 7,775,226 | B2 | 8/2010 | MacDonald et al. | |
| 7,806,130 | B2 | 10/2010 | Gobel | |
| D631,243 | S | 1/2011 | Forthuber et al. | |
| 7,861,734 | B2 | 1/2011 | Ma | |
| 7,891,367 | B2 | 2/2011 | Ma | |
| 7,900,643 | B2 | 3/2011 | Ma | |
| 7,913,708 | B2 | 3/2011 | Yung | |
| 7,913,709 | B2 | 3/2011 | Brebner | |
| D637,388 | S | 5/2011 | You | |
| D640,464 | S | 6/2011 | Forthuber et al. | |
| 7,980,262 | B1 | 7/2011 | You | |
| 8,020,572 | B2 | 9/2011 | Ma | |
| 8,053,042 | B1 | 11/2011 | Loomis | |
| 8,061,375 | B2 | 11/2011 | Ma | |
| D650,984 | S | 12/2011 | Pineda | |
| 8,082,935 | B2 | 12/2011 | Ma | |
| 8,096,310 | B2 | 1/2012 | Clarke | |
| 8,100,139 | B2 | 1/2012 | Chong | |
| D664,760 | S | 8/2012 | Elder | |
| 8,272,391 | B2 | 9/2012 | Luo | |
| 8,298,633 | B1 | 10/2012 | Chen | |
| 8,443,819 | B2 | 5/2013 | Beaulieu | |
| 8,522,804 | B1 * | 9/2013 | Tung | A45B 25/14 135/20.1 |
| D704,044 | S | 5/2014 | Makino | |
| D714,132 | S | 9/2014 | Hazantonis | |
| 8,899,250 | B1 * | 12/2014 | Tung | A45B 25/14 135/20.1 |
| D727,469 | S | 4/2015 | Jorgensen | |
| 9,004,087 | B2 | 4/2015 | Ma | |
| D731,166 | S | 6/2015 | Ma | |
| 9,113,683 | B2 | 8/2015 | Ma | |
| D753,271 | S | 4/2016 | LaBarbera et al. | |
| D759,955 | S | 6/2016 | Ma | |
| D759,956 | S | 6/2016 | McQuaid | |
| 9,504,298 | B2 | 11/2016 | Li | |
| 9,844,288 | B2 | 12/2017 | Fu | |
| D818,697 | S | 5/2018 | Ma | |
| 10,016,033 | B2 | 7/2018 | Volin | |
| 10,562,172 | B1 | 2/2020 | Armstrong | |
| 10,736,390 | B2 * | 8/2020 | Ma | A45B 25/06 |
| 10,758,015 | B2 | 9/2020 | Ma | |
| 10,945,381 | B1 | 3/2021 | Pringnitz | |
| 11,123,857 | B1 | 9/2021 | Ramsey | |
| 11,206,903 | B2 | 12/2021 | Ma | |
| 11,388,963 | B2 | 7/2022 | Ma | |
| 11,771,186 | B2 | 10/2023 | Ma | |
| D1,003,592 | S | 11/2023 | Ma | |
| 2001/0017150 | A1 | 8/2001 | Doreste | |
| 2002/0083969 | A1 | 7/2002 | Tung | |
| 2002/0139405 | A1 | 10/2002 | Lee | |
| 2003/0010367 | A1 | 1/2003 | Ko | |
| 2003/0015230 | A1 | 1/2003 | Glatz | |
| 2003/0062073 | A1 | 4/2003 | Tung | |
| 2004/0031513 | A1 | 2/2004 | Bunch et al. | |
| 2004/0055627 | A1 | 3/2004 | P. Moga | |
| 2004/0055628 | A1 | 3/2004 | Yu | |
| 2004/0069333 | A1 | 4/2004 | Ma | |
| 2004/0154525 | A1 | 8/2004 | Wirth et al. | |
| 2004/0182429 | A1 | 9/2004 | Chen | |
| 2004/0187900 | A1 * | 9/2004 | Earnshaw | A45B 17/00 135/39 |
| 2004/0206382 | A1 | 10/2004 | Clarke | |
| 2004/0206383 | A1 | 10/2004 | Clarke | |
| 2005/0081902 | A1 | 4/2005 | Liu | |
| 2005/0098200 | A1 | 5/2005 | Su | |
| 2005/0238422 | A1 | 10/2005 | Hung | |
| 2005/0279520 | A1 | 12/2005 | Newman et al. | |
| 2006/0005867 | A1 | 1/2006 | Chang | |
| 2006/0046899 | A1 | 3/2006 | Wang | |
| 2006/0151018 | A1 | 7/2006 | Wilson | |
| 2006/0151019 | A1 | 7/2006 | Lo | |
| 2007/0113878 | A1 | 5/2007 | Ko | |
| 2007/0261728 | A1 * | 11/2007 | Lin | A45B 17/00 135/20.1 |
| 2008/0041433 | A1 | 2/2008 | Caldwell | |
| 2008/0053498 | A1 | 3/2008 | Liu et al. | |
| 2008/0202570 | A1 | 8/2008 | Clarke | |
| 2009/0126769 | A1 | 5/2009 | Hoogendoorn | |
| 2009/0242065 | A1 | 10/2009 | Whitling et al. | |
| 2010/0139724 | A1 | 6/2010 | Lai | |
| 2010/0139725 | A1 | 6/2010 | Lai | |
| 2011/0061694 | A1 | 3/2011 | Vanderminden, Sr. | |
| 2011/0132418 | A1 | 6/2011 | Ma | |
| 2011/0209732 | A1 | 9/2011 | Ma | |
| 2011/0214705 | A1 | 9/2011 | Ma | |
| 2011/0241389 | A1 | 10/2011 | Tsai | |
| 2011/0277800 | A1 | 11/2011 | Tung | |
| 2012/0126533 | A1 | 5/2012 | Canale | |
| 2012/0155958 | A1 | 6/2012 | Donohue | |
| 2014/0109942 | A1 | 4/2014 | Ma | |
| 2014/0305476 | A1 | 10/2014 | Ma | |
| 2014/0376990 | A1 | 12/2014 | Lai | |
| 2015/0237976 | A1 | 8/2015 | Chow | |
| 2018/0298632 | A1 * | 10/2018 | Ma | A45B 17/00 |
| 2019/0082802 | A1 | 3/2019 | Ma | |
| 2019/0323531 | A1 | 10/2019 | Wang | |
| 2020/0297085 | A1 | 9/2020 | Ma | |
| 2020/0384328 | A1 | 12/2020 | Chua | |
| 2021/0112932 | A1 | 4/2021 | Ma | |
| 2022/0265013 | A1 | 8/2022 | Ma | |
| 2022/0400822 | A1 | 12/2022 | Ma | |
| 2023/0018195 | A1 | 1/2023 | Ma | |
| 2023/0270216 | A1 | 8/2023 | Ma | |

FOREIGN PATENT DOCUMENTS

| | | |
|---|---|---|
| CN | 2579212 | 10/2003 |
| CN | 202060155 | 12/2011 |
| CN | 202190859 | 4/2012 |
| CN | 202588579 | 12/2012 |
| CN | 202636818 | 1/2013 |
| CN | 203168230 | 9/2013 |
| CN | 204181115 | 3/2015 |
| CN | 106889721 | 4/2017 |
| CN | 208280719 | 12/2018 |
| CN | 210581325 | 5/2020 |
| CN | 211229881 | 8/2020 |
| DE | 22 04 217 | 8/1973 |
| DE | 24 34 495 | 2/1975 |
| DE | 3820573 | 8/1989 |
| DE | 29516009 | 11/1995 |
| DE | 202010011240 | 11/2010 |
| DE | 202012007364 | 11/2012 |
| DE | 202017002887 | 7/2017 |
| DE | 202019103816 | 7/2019 |
| EM | EU 007772157-0001 | 3/2020 |
| EP | 0 628 264 | 12/1994 |
| EP | 1 302 120 | 3/2005 |

(56) References Cited

FOREIGN PATENT DOCUMENTS

| | | | | |
|---|---|---|---|---|
| EP | 1 510 145 | | 3/2005 | |
| EP | 2 289 364 | | 3/2011 | |
| EP | 4 118 998 | | 1/2023 | |
| FR | 2612551 | A1 * | 9/1988 | ..... E04H 15/58 |
| FR | 2672781 | A3 | 8/1992 | |
| JP | 58-107024 | | 7/1983 | |
| JP | S61-37814 | | 3/1986 | |
| JP | H08-322621 | | 12/1996 | |
| JP | 2000-139533 | | 5/2000 | |
| JP | 2001-046131 | | 2/2001 | |
| JP | 2006-110317 | A | 4/2006 | |
| JP | 2007-222591 | | 9/2007 | |
| JP | 2008-142310 | | 6/2008 | |
| JP | 3144314 | | 7/2008 | |
| JP | 2009-045359 | | 3/2009 | |
| JP | 2009-247750 | | 10/2009 | |
| WO | WO 2005/058089 | | 6/2005 | |
| WO | WO 2007/092514 | | 8/2007 | |
| WO | WO 2013/013474 | | 1/2013 | |
| WO | WO 2018/084181 | | 5/2018 | |

OTHER PUBLICATIONS

Amazon.com, Site visited Feb. 7, 2023, ITT AHO Heavy Duty Telescoping Extension Pole, First available Dec. 21, 2019, https://us.amazon .com/ITTAHO-Aluminum-Telescopic-Extension-Telescoping/dp/B07ZT8M9VD (Year: 2019).

Shadeaustralia.com.au, Site visited Jan. 23, 2023, Shelta Como Umbrella, oldest review dated Dec. 7, 2017, https://www.shadeaustralia.com.au/como-timber-umbrella (Year: 2017).

Youtube.com, Site visited Jan. 24, 2023, "Cool Pool Products Umbrella Sleeve," published on Jul. 19, 2019 by CoolPoolProducts: https:// www .youtube.com/watch?v=x_qAK8QDJ Ko&list=TLGGy0td2PTduXUyNDAxMjAyMw (Year: 2019).

Youtube.com, Site visited Feb. 10, 2023, "Testrite Telescopic Tubing and Locks," published by Testrite on Sep. 26, 2017 features the FA Spring Button A-Clutch Lock: https://www.youtube.com/watch?v=Lp2uGtOGZRA (Year: 2017).

* cited by examiner

UMBRELLA WITH HUB REINFORCED TILT COUPLING

This application claims the benefit of U.S. Patent Application No. 63/105,707, filed Oct. 26, 2020, the entirety of which is hereby incorporated by reference.

BACKGROUND

Field

This application is directed to a device to tilt an upper portion of an umbrella relative to a lower portion.

Description of the Related Art

Patio umbrellas are well known. Among patio umbrellas, some designs allow the location of shade cast thereby to be altered by tilting an upper part of the umbrella relative to a lower part of a pole that supports the upper part of the umbrella. Such tilting function can be provided by a hinge disposed along the length of a pole between two pole segments that can be angled to one another.

SUMMARY

While integrating a tilting function into the umbrella pole provides a sleek design, the joint is a focal point of stress on of the umbrella assembly. It would be useful to improve the design, performance, and durability of tilting umbrellas. It would be beneficial to provide a support for the umbrella pole in the vicinity of the tilting. It would be advantageous to locate a support structure outside the umbrella pole. Novel designs that reinforce in an unobtrusive manner would be desirable.

According to one aspect, an umbrella including an upright pole with an upper pole portion and a lower pole portion. A canopy assembly includes a lower hub and a plurality of support members coupled with the lower hub. A tilt mechanism includes an actuator coupled with the lower pole portion. The tilt mechanism is configured to adjust the upper pole portion from a first configuration in which the upper pole portion is aligned with the lower pole portion to a second configuration in which the upper pole portion is tilted relative to the lower pole portion. The lower hub is disposed at a tilt location of the upright pole when the upper pole portion is tilted relative to the lower pole portion.

According to another aspect, the tilt mechanism includes an upper portion, a lower portion, and a driver having an end engaged within a channel such that moving the driver along an axis of the upright pole moves the end of the driver within the channel and tilts the upper pole portion between the first configuration and the second configuration.

According to another aspect, the tilt mechanism further includes a spring component configured to store strain energy when the driver is moved such that the tilt mechanism is biased to the first configuration.

According to another aspect, the tilt mechanism includes a sleeve disposed about the lower pole portion, the sleeve being coupled with a tension member disposed through the lower pole portion and being engaged with the driver such that moving the sleeve along the lower pole portion away from the canopy assembly moves the end of the driver within the channel and tilts the upper pole portion between the first configuration and the second configuration.

According to another aspect, the tilt mechanism further includes a locking ring for retaining the sleeve in a tilt position disposed away from the canopy assembly.

According to another aspect, the umbrella includes a mechanism configured to open and close the canopy assembly that is separate from the tilt mechanism.

According to another aspect, the tilt mechanism includes a channel configured for routing a cord through the tilt mechanism between a spool and a pulley of an opening and closing mechanism.

According to another aspect, the tilt mechanism includes an opening and closing mechanism including a spool and a crank disposed on the lower pole portion and a cord extending over a pulley on the upper pole portion, an end of the cord engaged with the lower hub such that cranking the spool in a first direction raises the lower hub to open the canopy assembly and engages the lower hub with the driver, and further cranking in the first direction moves the end of the driver within the channel and tilts the upper pole portion between the first configuration and the second configuration.

According to another aspect, the upper pole portion is tilted relative to the lower pole portion at a pivot axis disposed transverse to the lower pole portion, the lower hub being intersected by the pivot axis when the upper pole portion is tilted relative to the lower pole portion.

According to another aspect, the lower hub is jointed to permit a first portion to be aligned with the lower pole portion and a second portion to be tilted relative to the first portion such that the second portion can be aligned with an upper pole portion when the upper pole portion is angled relative to the lower pole portion.

According to another aspect, the first portion is pivotable about an axis relative to the second portion.

According to another aspect, the second portion of the lower hub includes an inner portion that has a spherical outer surface and the first portion of the lower hub includes an outer portion that has an inner cavity with an inner wall configured to pivot over the spherical outer surface of the inner portion.

According to another aspect, the inner portion of the lower hub includes a plurality of circular projections disposed in a plurality of circular recesses disposed in the outer portion of the lower hub.

According to another aspect, the circular recesses has an elongate slot including a semi-circular end surface.

According to another aspect, the lower hub includes a lower hub portion including the elongate slot and an upper hub portion including a plurality of trapping elements configured to trap the circular projections in the circular recesses.

According to another aspect, an umbrella includes an upright pole including an upper pole portion and a lower pole portion. A canopy assembly includes an upper hub coupled with the upper pole portion, a lower hub, and a plurality of support members coupling the upper hub with the lower hub. The lower hub includes an inner portion disposed about the upright pole and an outer portion disposed about the inner portion. A first mechanism is for moving the lower hub along the upright pole between a lowered position corresponding to a closed configuration of the canopy assembly and a raised position corresponding to an open configuration of the canopy assembly. A second mechanism including an actuator coupled with the lower pole portion is configured to adjust the upper pole portion from a first configuration in which the upper pole portion is aligned with the lower pole portion to a second configuration in which the upper pole portion is tilted relative to the lower pole portion. The lower hub is disposed at a pivot location of the upright pole when the upper pole portion is tilted relative to the lower pole portion and the outer portion of the lower hub is tilted relative to the inner portion of the lower hub.

According to another aspect, a tilt mechanism including a lower coupler coupled with the lower pole portion, an upper coupler coupled with the upper pole portion, and a pivot axis disposed transverse to the lower pole portion, the lower hub being intersected by the pivot axis when the upper pole portion is tilted relative to the lower pole portion.

According to another aspect, the outer portion of the lower hub is tilted relative to the inner portion of the lower hub when the upper pole portion is tilted relative to the lower pole portion.

According to another aspect, the inner portion of the lower hub includes a spherical outer surface and the outer portion of the lower hub includes an inner cavity with a spherical inner wall configured to pivot over the spherical outer surface of the inner portion.

According to another aspect, the inner portion of the lower hub includes a plurality of circular projections disposed in a plurality of circular recesses disposed in the outer portion of the lower hub.

According to another aspect, the circular recesses has an elongate slot including a semi-circular end surface.

According to another aspect, the lower hub includes a lower hub portion including the elongate slot and an upper hub portion including a plurality of trapping elements configured to trap the circular projections in the circular recesses.

According to another aspect, an umbrella includes an upright pole including an upper pole portion and a lower pole portion. A canopy assembly includes a lower hub and a plurality of support members coupled with the lower hub. The lower hub includes an inner portion disposed about the upright pole and an outer portion disposed about the inner portion. A tilt mechanism includes an actuator coupled with the lower pole portion. The tilt mechanism is configured to adjust the upper pole portion from a first configuration in which the upper pole portion is aligned with the lower pole portion to a second configuration in which the upper pole portion is angled relative to the lower pole portion. The outer portion of the lower hub is angled relative to the inner portion of the lower hub when the upper pole portion is angled relative to the lower pole portion.

According to another aspect, the inner portion of the lower hub includes a spherical outer surface and the outer portion of the lower hub includes an inner cavity with an inner wall moveable over the spherical outer surface of the inner portion.

According to another aspect, the inner portion of the lower hub includes a plurality of pivot projections disposed on opposite sides of the inner portion and disposed in a corresponding plurality of pivot recesses in the outer portion of the lower hub.

According to another aspect, the pivot recesses has an elongate slot including an arcuate end surface.

According to another aspect, the lower hub includes a first hub portion including the elongate slot and a second hub portion including a plurality of trapping elements configured to trap the pivot projections in the pivot recesses.

According to another aspect, an opening and closing mechanism is configured to operate independently of the second mechanism.

According to another aspect, the umbrella includes a stop member disposed on the upright pole configured to contact at top surface of the lower hub when the lower hub is aligned with a pivot axis of the second mechanism about which the second mechanism is configured to adjust the upper pole portion from the first configuration to the second configuration.

According to another aspect, an umbrella includes a canopy assembly including an upper hub and a lower hub. An upright pole including an upper pole portion and a lower pole portion. A tilt mechanism couples with the upper pole portion and the lower pole portion and is configured to support the upper pole portion in a first configuration in which the upper pole portion is aligned with the lower pole portion and a second configuration in which the upper pole portion is angled relative to the lower pole portion. An actuator is on the lower pole portion configured to move the tilt mechanism between the first and second configurations. The actuator includes a sleeve assembly disposed on the lower pole portion and a connection member coupled with the sleeve assembly and the tilt mechanism. The sleeve assembly is movable from a raised position corresponding to the second configuration of the tilt mechanism to a lowered position corresponding to the first configuration of the tilt mechanism.

According to another aspect, the sleeve assembly includes a locking sleeve and an outer sleeve, the outer sleeve disposed over the locking sleeve.

According to another aspect, the locking sleeve includes a projection and the lower pole portion includes a recess configured to receive the projection, the projection configured to be disposed within the recess in the lowered position.

According to another aspect, the outer sleeve is movable relative to the locking sleeve such that sliding the outer sleeve downwards over the locking sleeve in the lowered position locks the projection within the recess and sliding the outer sleeve upwards over the locking sleeve releases the projection from the recess to allow movement of the sleeve assembly to the raised position.

According to another aspect, the outer sleeve includes an inner recess configured to receive the projection in the raised position.

According to another aspect, an upper end of the locking sleeve includes a radially outwardly extending flange and the outer sleeve includes an inner shelf, the radially outwardly extending flange configured to catch on the inner shelf and raise the locking sleeve as the outer sleeve is moved into the raised position.

According to another aspect, the sleeve assembly further includes a pole shield configured to cover the recess in the raised position and movable to provide access to the recess in the lowered position.

According to another aspect, the pole shield is fixedly coupled with the locking sleeve.

According to another aspect, the connection member is disposed within the lower pole portion and coupled with the locking sleeve through a slot in the lower pole portion.

According to another aspect, the connection member includes a pin, first and second ends of the pin coupled with the locking sleeve through the slot.

According to another aspect, the tilt mechanism includes an upper portion, a lower portion, and a driver having an end engaged within a channel such that moving the driver along an axis of the upright pole moves the end of the driver within the channel and tilts the upper pole portion between the first configuration and the second configuration.

According to another aspect, the tilt mechanism further includes a spring component configured to store strain energy when the driver is moved such that the tilt mechanism is biased to the first configuration.

According to another aspect, the tilt mechanism includes a sleeve disposed about the lower pole portion, the sleeve being coupled with a tension member disposed through the lower pole portion and being engaged with the driver such that moving the sleeve along the lower pole portion away from the canopy assembly moves the end of the driver within the channel and tilts the upper pole portion between the first configuration and the second configuration.

According to another aspect, the tilt mechanism further includes a locking ring for retaining the sleeve in a tilt position disposed away from the canopy assembly.

According to another aspect, further including a mechanism configured to open and close the canopy assembly that is separate from the tilt mechanism.

BRIEF DESCRIPTION

These and other features, aspects and advantages are described below with reference to the drawings, which are intended to illustrate but not to limit the inventions. In the drawings, like reference characters denote corresponding features consistently throughout similar implementations. The following is a brief description of each of the drawings.

DETAILED DESCRIPTION

While the present description sets forth specific details of various implementations, it will be appreciated that the description is illustrative only and should not be construed in any way as limiting. Furthermore, various applications of such implementations and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1A:
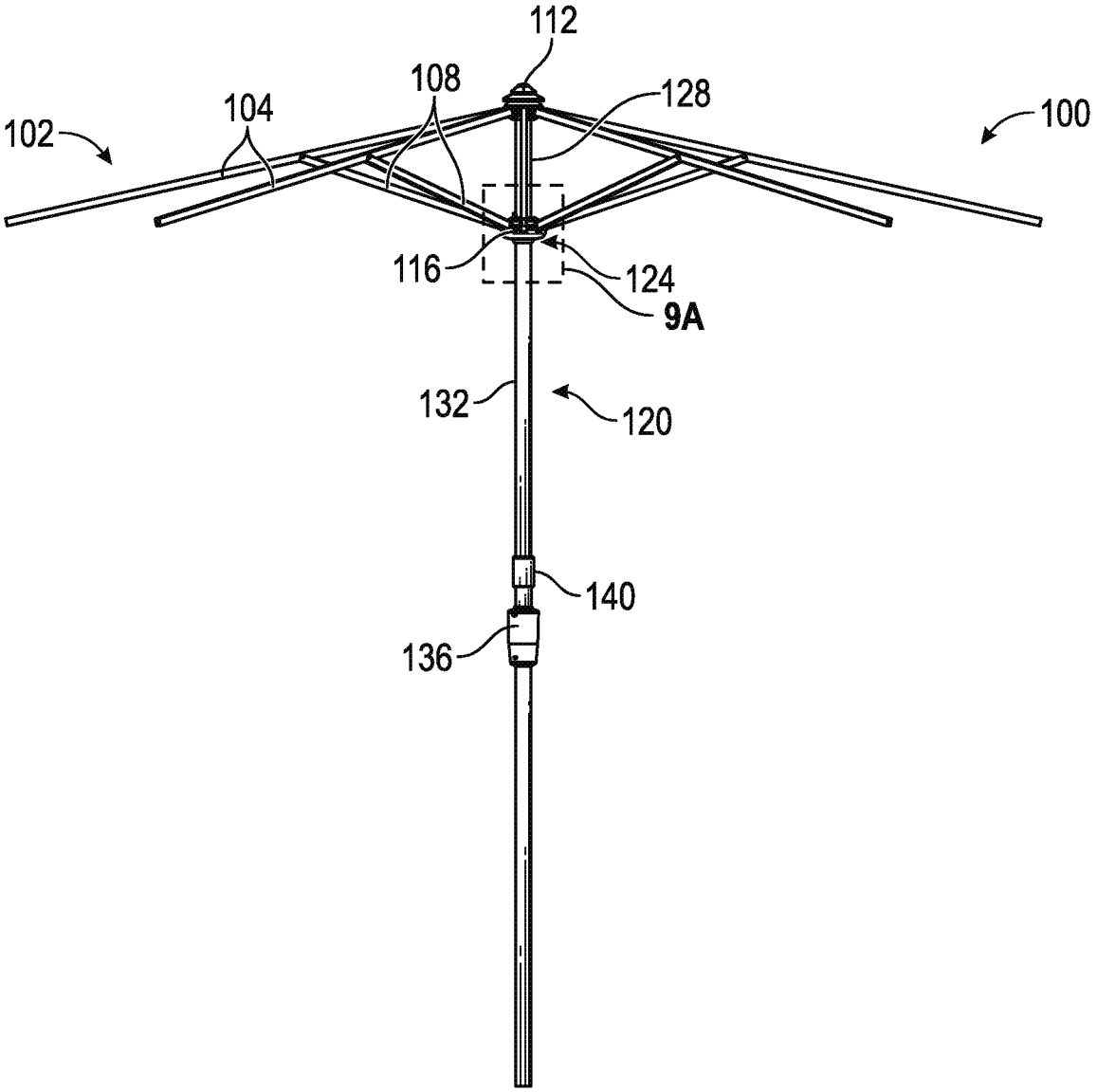
FIG. 1A is a side view of an umbrella frame of an umbrella that can be opened in an upright configuration.

FIG. 1A illustrates an umbrella 100. The umbrella 100 can include a canopy assembly 102. The canopy assembly 102 can include plurality of ribs 104 and a plurality of corresponding struts 108. The ribs 104 and struts 108 can provide support to a shade member or canopy fabric. The canopy fabric can provide shade and/or protection from the weather for persons and objects located underneath the canopy fabric. The canopy fabric should be flexible to facilitate folding the canopy assembly 102 and can be formed of canvas, plastic mesh, or other sheet material.

One end of each of the ribs 104 can be pivotably coupled with an upper hub 112. The upper hub 112 can be coupled with a central pole 120. The central pole 120 is generally mounted or supported vertically, and so is sometimes referred to as an upright pole. One end of each of the struts 108 can be pivotably coupled with a lower hub 116. The ends of the ribs 104 and the struts 108 coupled to the hubs 112, 116 respectively are inner ends in that they are closer than the opposite ends thereof to a central axis of the central pole 120 when the canopy assembly 102 is open. The lower hub 116 can be moveably, e.g., slideably, mounted on the central pole 120. An opposite end of each of the struts 108 can be pivotably coupled with a corresponding rib of the ribs 104. The canopy assembly 102, which can also include the hubs 112, 116, can be opened and closed by movement of the lower hub 116 along the central pole 120. The canopy assembly 102 can be opened by raising the lower hub 116 along the central pole 120 from a lowered position in which the canopy assembly 102 is closed. The canopy assembly 102 can be closed by lowering the lower hub 116 along the central pole 120 from a position of the lower hub 116 in which the canopy assembly is open.

The umbrella 100 can include an opening and closing mechanism 136, which can be a first mechanism of the umbrella 100. The opening and closing mechanism 136 is sometimes referred to herein by the shorthand open/close mechanism 136. The opening and closing mechanism 136 can be mounted on, in or partly on and partly in the central pole 120. The opening and closing mechanism 136 can be part of the structure to control the position of the lower hub 116 along the central pole 120. The open/close mechanism 136 can include a crank handle 137 attached to a spool (not shown). The spool can be attached to a tension transferring member (not shown), such as a string, a wire, a cord, or other similar member configured to transfer a force to one or both of the hubs 112, 116 and also configured to be wound on the spool. The cord or other tension transferring member can be coupled at one end with the spool and at an opposite end with the lower hub 116. The cord can pass over a pulley located adjacent to or supported within the upper hub 112. By turning the spool using the crank handle 137 (see FIG. 1B), the winding or unwinding of the cord can correspondingly raise or lower the lower hub 116 and open or close the canopy assembly of the umbrella 100. The elevated position of the lower hub 116 can be held by locking the crank handle 137, which locks the cord, or otherwise locking the cord in place. The crank handle 137 may be locked by sufficient internal friction.

The umbrella 100 includes a tilt mechanism 124. The tilt mechanism 124 can be a dedicated mechanism that is provided to adjust the tilt angle of the canopy assembly 102 or components thereof, as discussed further below. As used herein, a dedicated mechanism is one that can provide only the tilt function as described herein. As used herein, a dedicated mechanism is one that provides the tilt function separate and apart from the open/close function of the canopy assembly. The tilt mechanism 124 can be a dedicated tilt mechanism that performs multiple functions, e.g., providing a tilted configuration from an aligned configuration and locking a portion of the umbrella 100 in a tilted configuration after the tilted portion has been tilted. The tilt mechanism 124 can be mounted along the central pole 120, as shown. The tilt mechanism 124 can also be used in a cantilever-style umbrella. In such an embodiment, the tilt mechanism 124 is disposed about an upright pole disposed to a side of a central portion of a canopy assembly. The tilt mechanism 124, or portions thereof, can be integrated into the opening and closing mechanisms 136 as discussed further below. The tilt mechanism 124 can divide the central pole 120 into an upper pole portion 128 and a lower pole portion 132. The lower pole portion 132 can be a first pole and the upper pole portion 128 can be a second pole and the tilt mechanism 124 can be disposed between and the first pole and the second pole. The tile mechanism 124 can couple the first pole to the second pole. The upper pole portion 128 can be coupled with an upper end or an upper portion of the tilt mechanism 124. The upper hub 112 can be coupled with an upper or portion or upper end of the upper pole portion 128. The lower pole portion 132 can be coupled with a lower end or lower portion of the tilt mechanism 124. Further details of tilt mechanisms for umbrellas are described below as well as in U.S. Pat. Pub. No. 2018/0298632 (Ma) and U.S. Pat. No. 6,446,650 (Ma), which are hereby incorporated herein by reference for purposes of further description of the upper and lower portions of various embodiments of tilt mechanisms and for all other purposes.

Figure 1B:
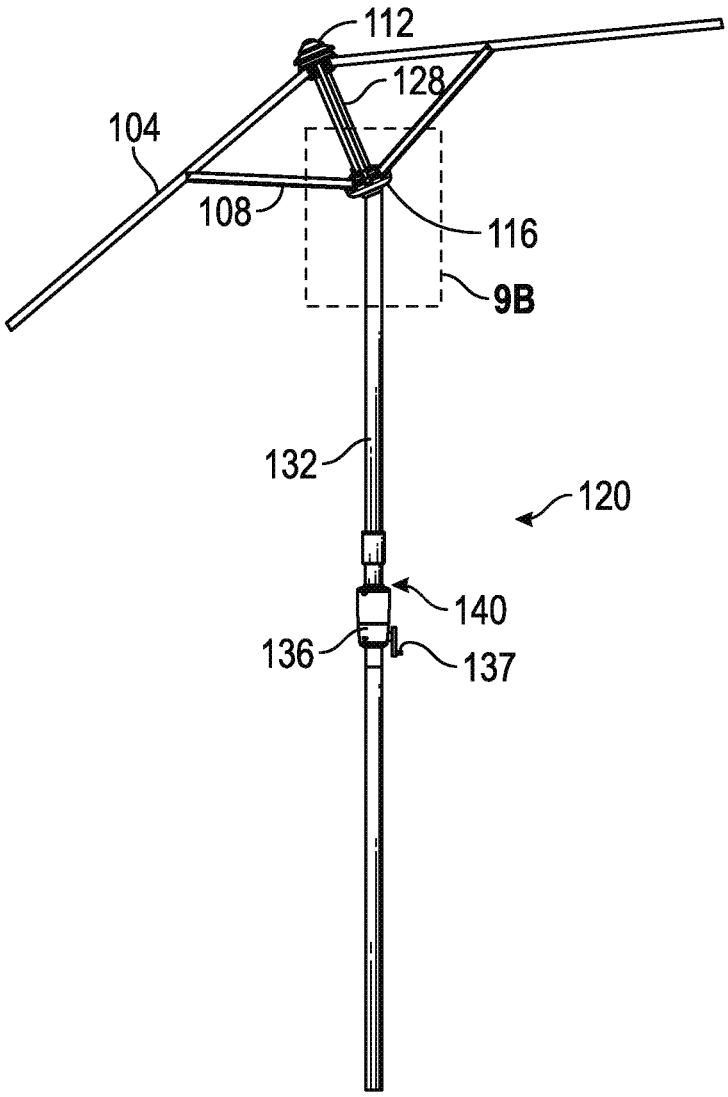
FIG. 1B is side view showing that the umbrella of FIG. 1A can be tilted from the upright position of FIG. 1A to a tilted position to provide better shade late when the sun is low in the sky.
Figure 2B:
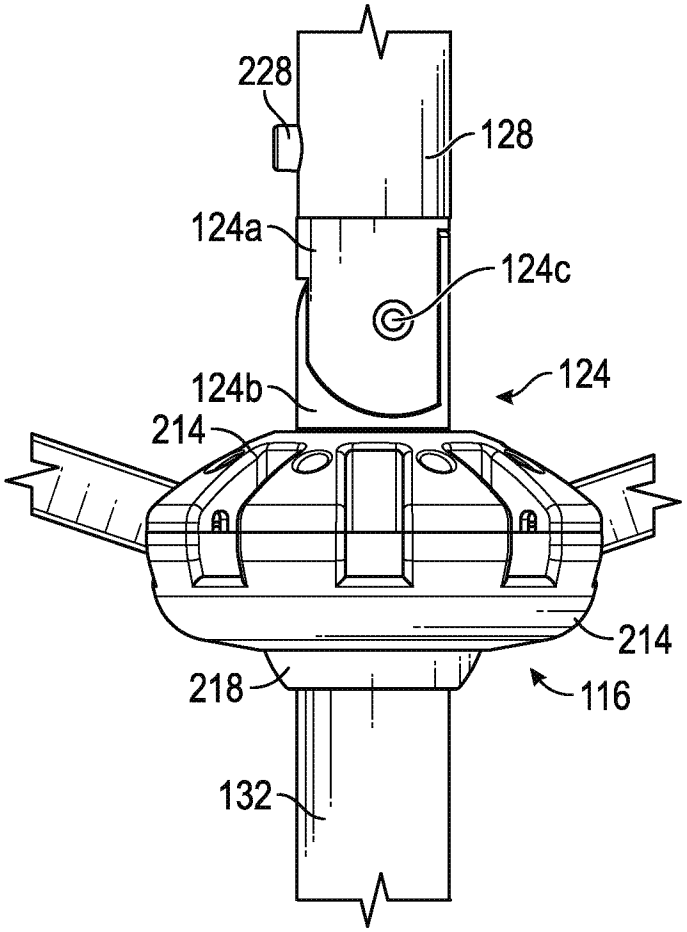
FIG. 2B is a side view of the lower hub below the elevated position illustrated in FIG. 2A with several of the struts having been removed.
Figure 2A:
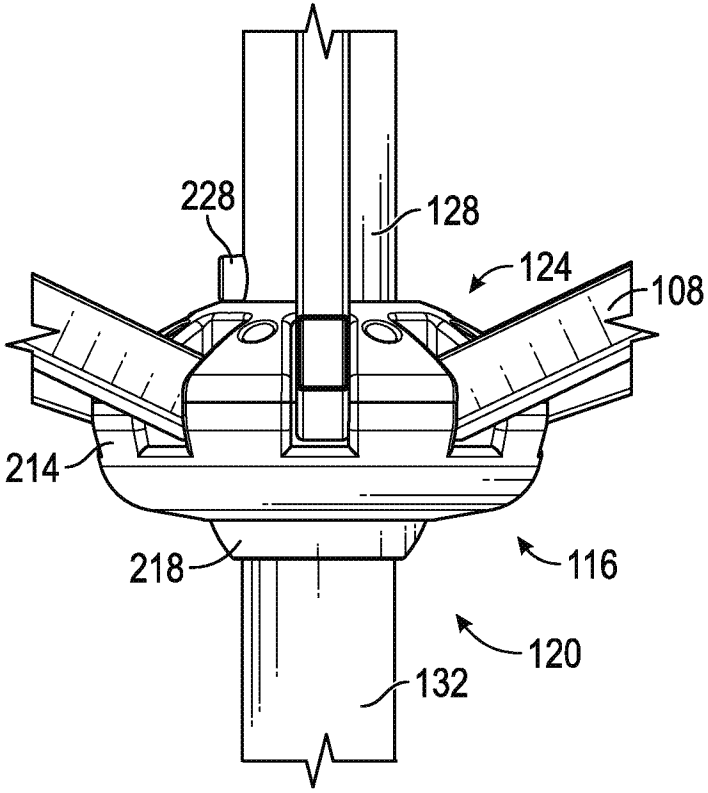
FIG. 2A is a side view of a lower hub at an elevated position.
Figure 9A:
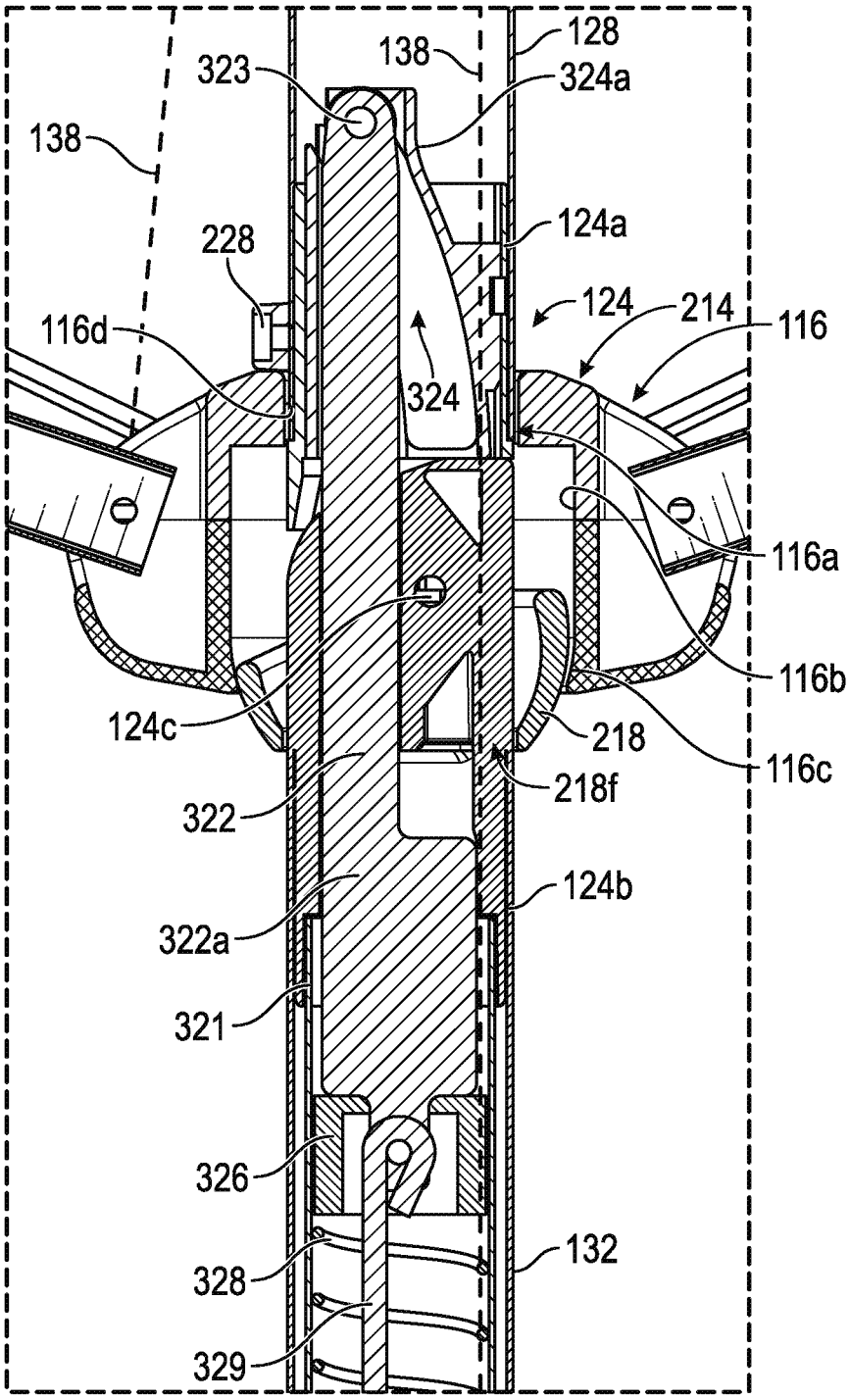
FIG. 9A is a cross-sectional view of the umbrella at Detail 9A in FIG. 1A.
Figure 9B:
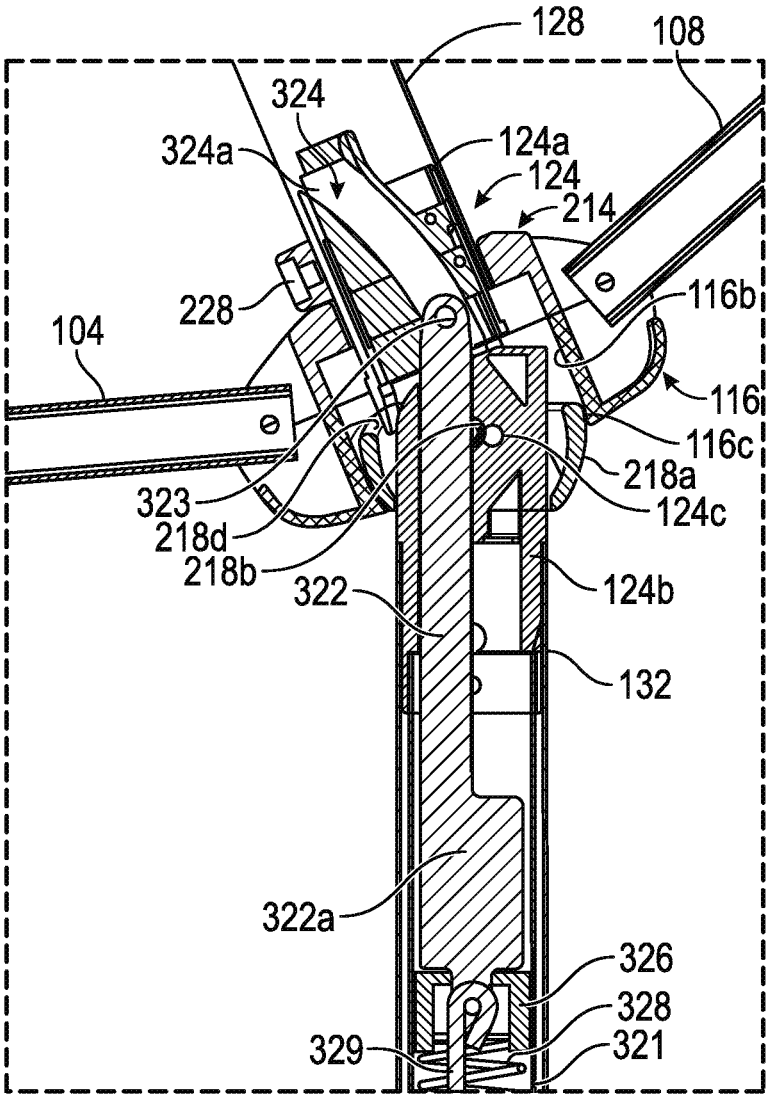
FIG. 9B is a cross-sectional view of the umbrella at Detail 9B in FIG. 1B.
Figure 10:
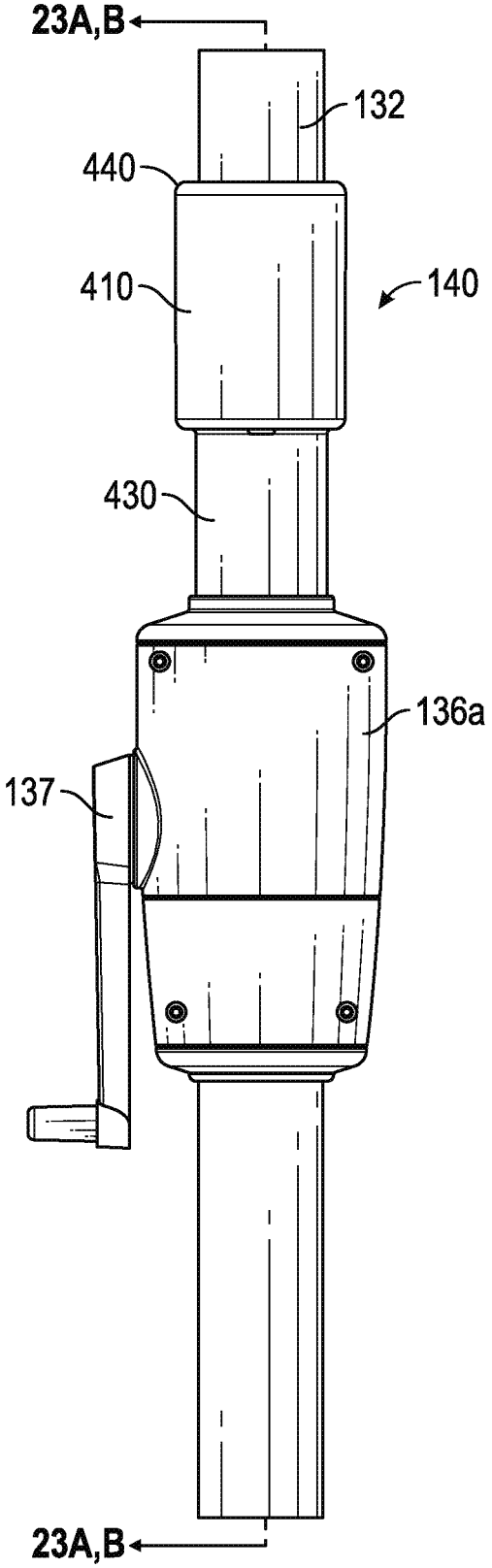
FIG. 10 is a side view of a crank mechanism and a slideable collar actuator for remotely operating a tilt mechanism such as the tilt mechanism of FIG. 8.
Figure 11:
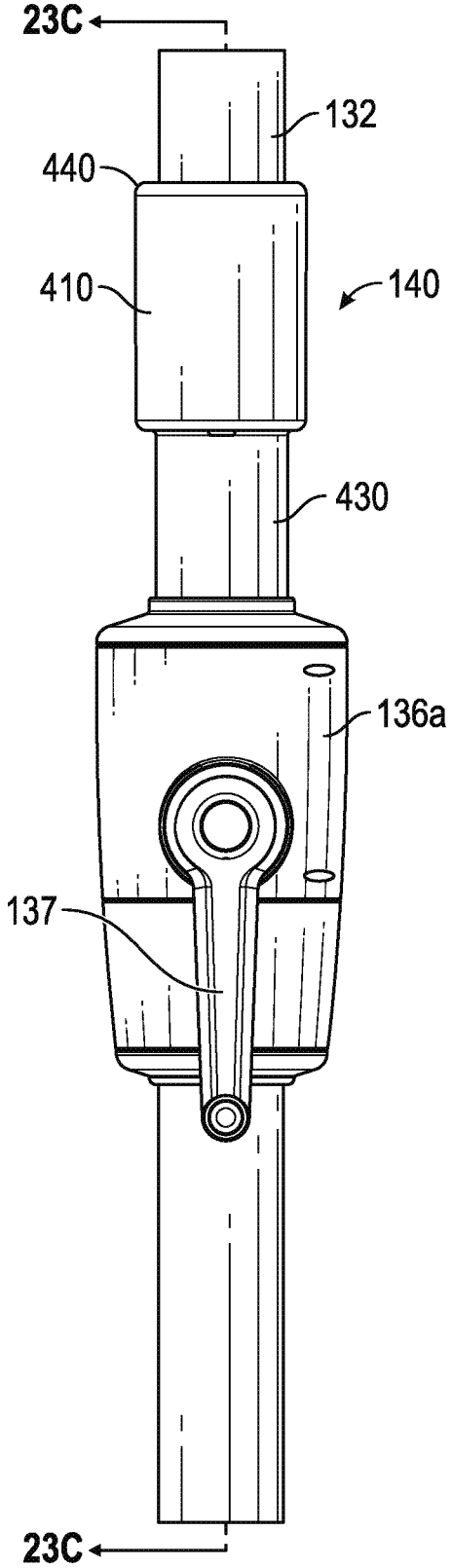
FIG. 11 is another side view of the crank mechanism and the slideable collar actuator FIG. 10.
Figure 12:
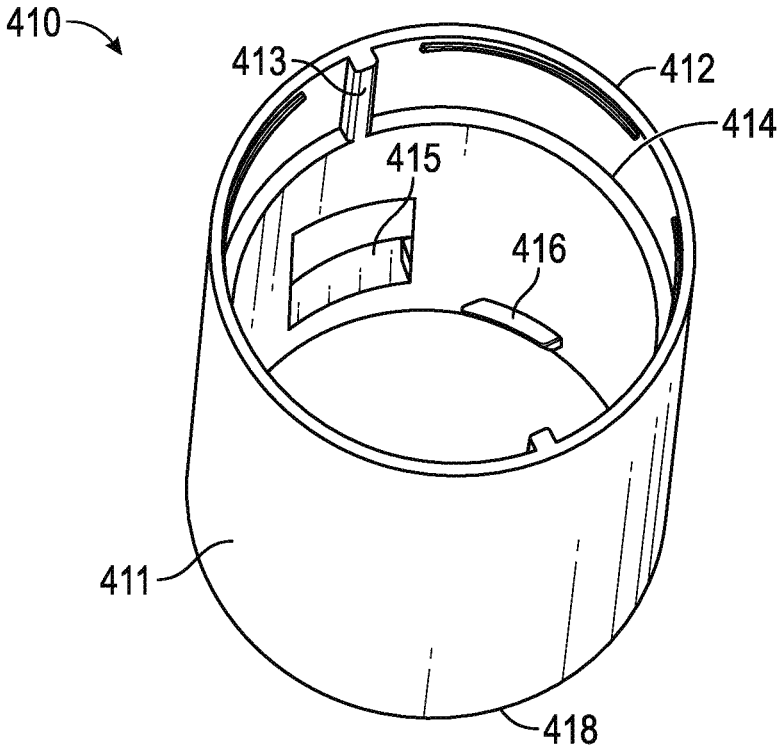
FIG. 12 is a perspective view of a collar of the slideable collar actuator.
Figure 13:
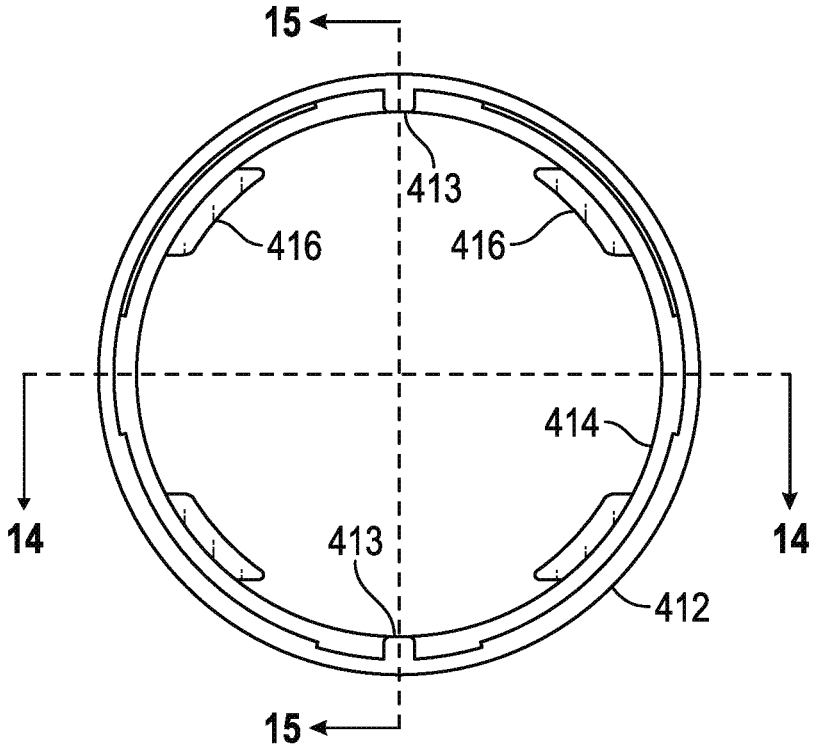
FIG. 13 is a top view of the slideable collar actuator of FIG. 12.
Figure 14:
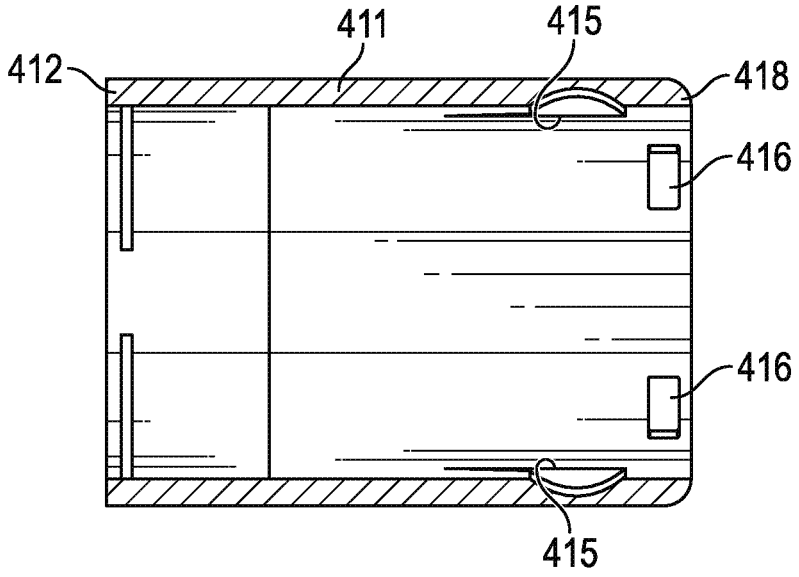
FIG. 14 is a cross-sectional view of the slideable collar actuator of FIGS. 12-13 taken along the line 14-14 in FIG. 13.
Figure 15:
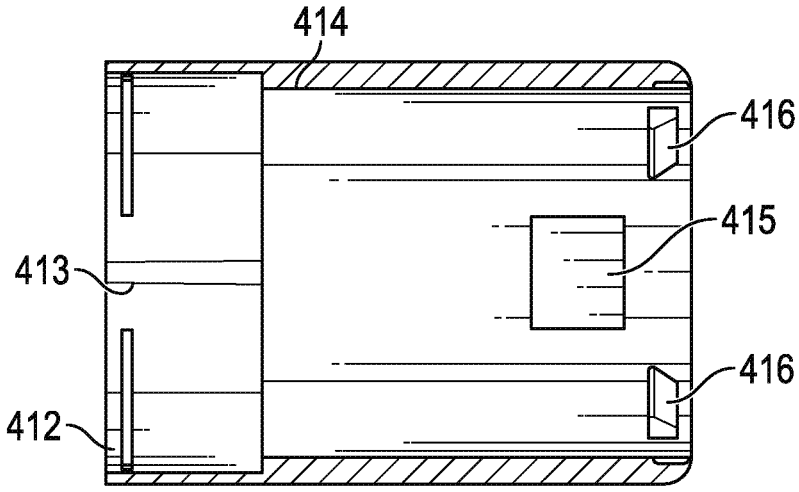
FIG. 15 is a cross-sectional view of the slideable collar actuator of FIGS. 12-13 taken along the line 15-15 in FIG. 13.
Figure 16:
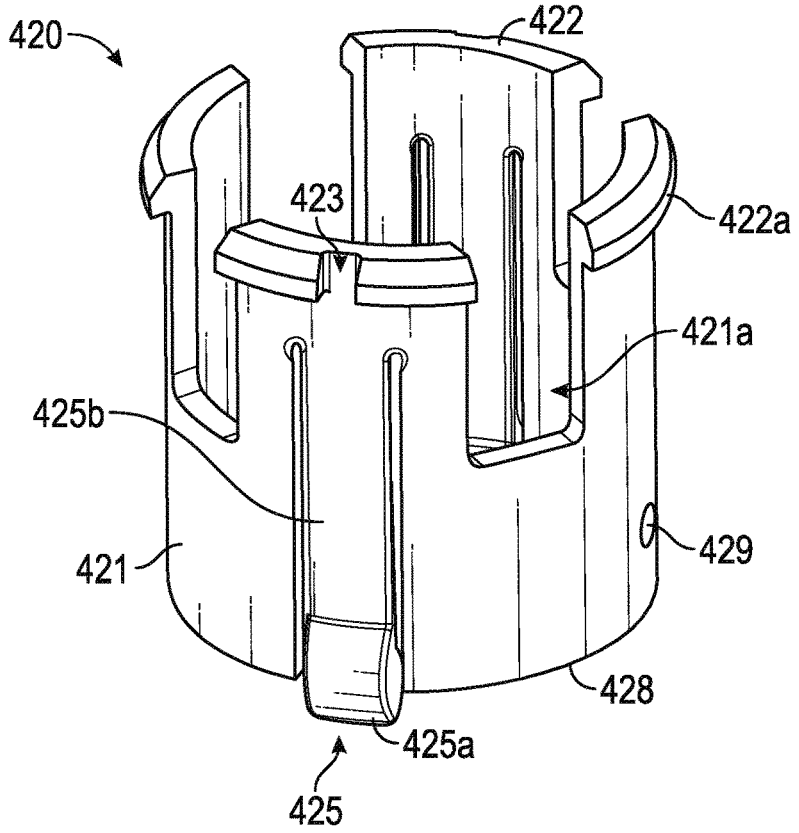
FIG. 16 is a perspective view of a locking ring of the slideable collar actuator of the slideable collar actuator of FIGS. 12-13.
Figure 17:
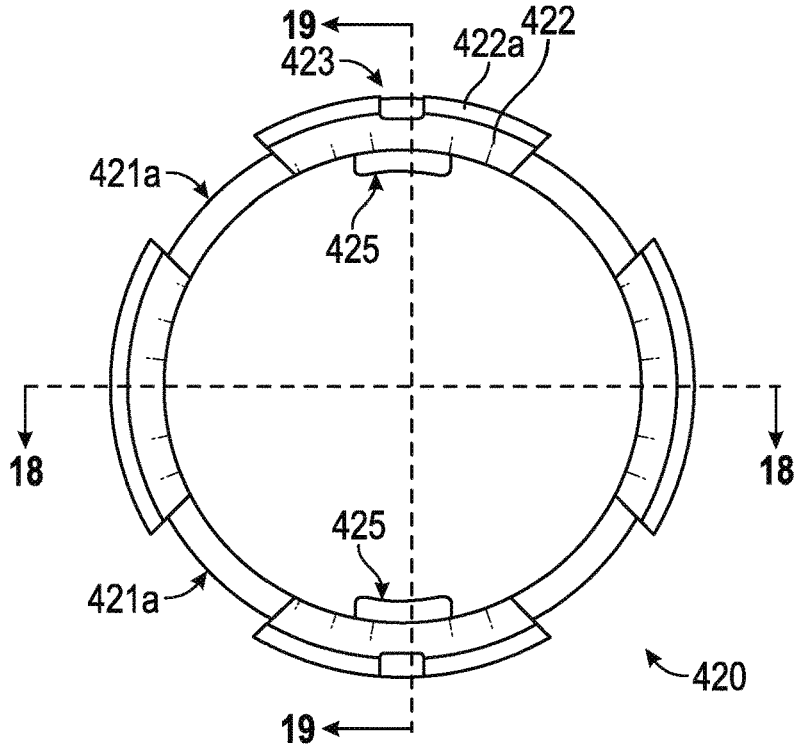
FIG. 17 is a top view of the locking ring of FIG. 16.
Figure 18:
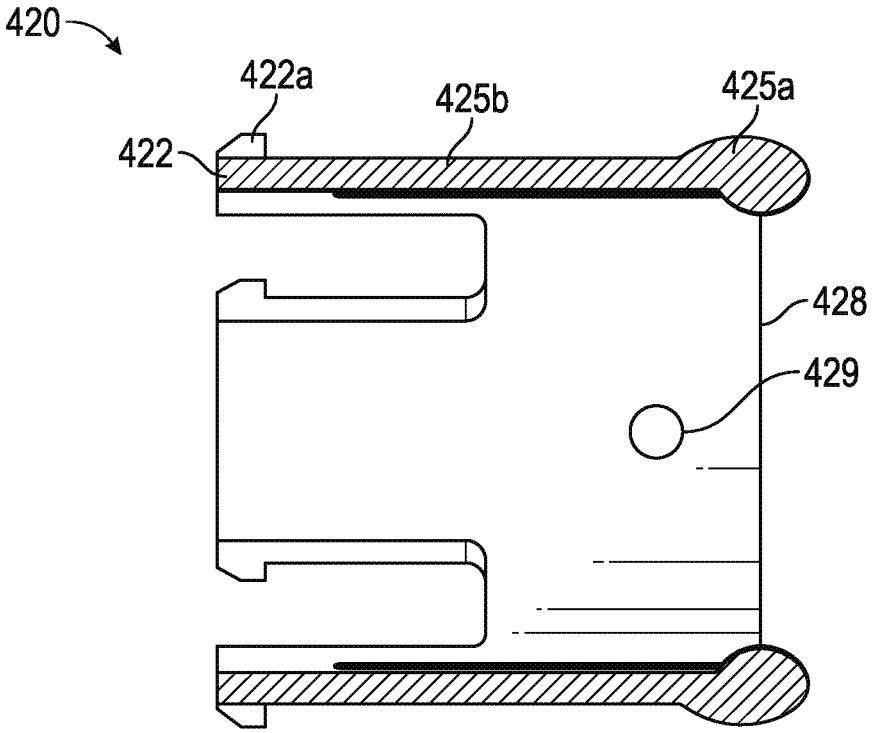
FIG. 18 is a cross-sectional view of the locking ring of FIG. 16 taken along the line 18-18 in FIG. 17.
Figure 19:
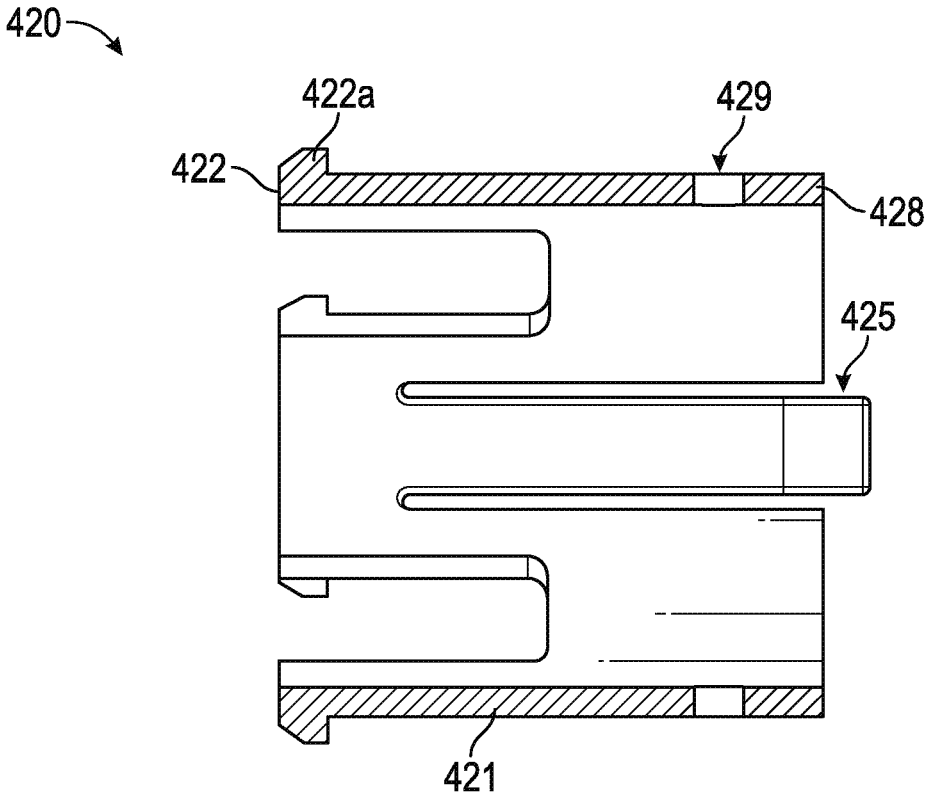
FIG. 19 is a cross-sectional view of the locking ring of FIG. 16 taken along the line 19-19 in FIG. 17.
Figure 20:
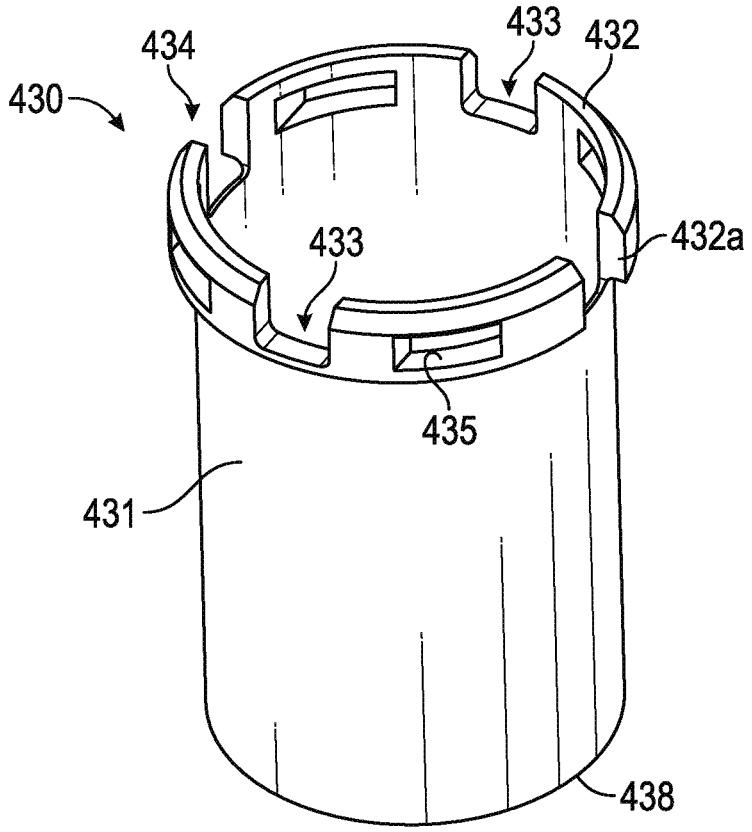
FIG. 20 is a perspective view of an outer sleeve to be disposed around an umbrella pole at least partially within and below the slideable collar actuator.
Figure 21:
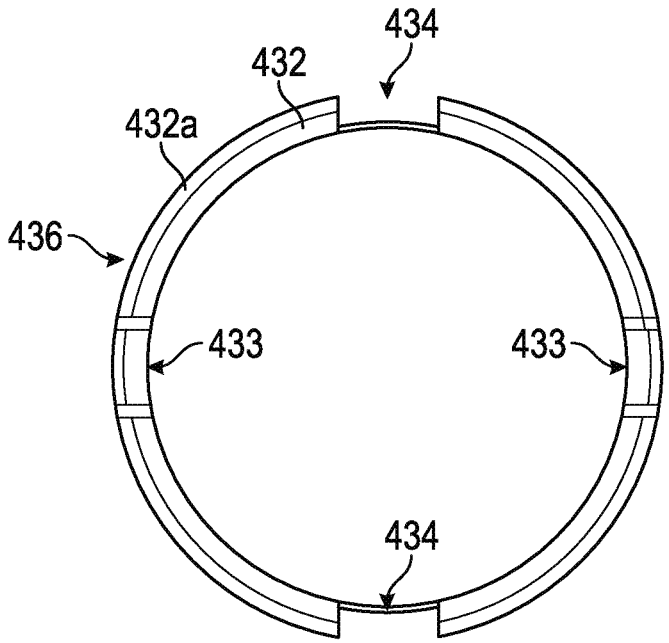
FIG. 21 is a top view of the outer sleeve of FIG. 20.
Figure 22:
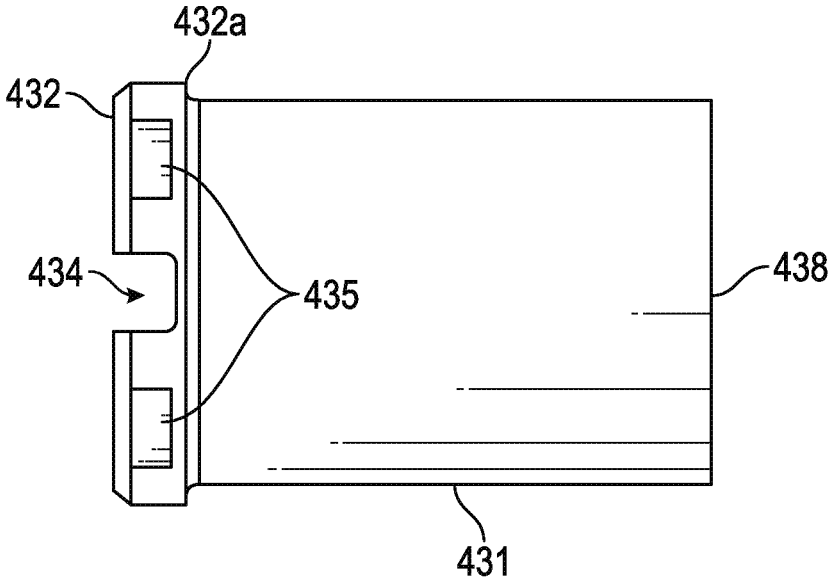
FIG. 22 is a side view of the outer sleeve of FIG. 20.

The tilt mechanism 124 can have a first configuration, which can be an untilted or aligned configuration as shown in FIGS. 1A, 2A, and 9A. In the untilted or aligned configuration, the upper and lower pole portions 128, 132 can be aligned along the same axis. The tilt mechanism 124 can have a second configuration which can be tilted relative to the first configuration, as shown in FIGS. 1B, 2B, and 9B. In the second configuration, the upper and lower pole portions 128, 132 can form an angle therebetween. The angle can have an apex at a pivot axis of the tilt mechanism 124. The first and the second configurations can both be tilted configurations, with the second configuration being more tilted than the first configuration. The tilt mechanism 124 can adjust between the first and second configurations.

The tilt mechanism 124 can be controlled by an actuator, such as the slideable collar actuator 140, discussed in more detail below. The actuator can have an independent and/or separate control mechanism from the open/close mechanism 136. The actuator can be operable by a person to selectively manipulate the tilt mechanism 124 between the first and second configurations. The actuator cam provide a dedicated control for the tilt configuration of the umbrella 100, being part of a mechanism that is not functionally combined with the opening and closing mechanism 136. A cord or a control rod (not shown) can couple the actuator with the tilt mechanism 124. A first end of the cord or control rod can be coupled with the actuator. A second end of the control rod or cord can be coupled with the tilt mechanism 124, as described further below in relation to the slideable collar actuator 140. Alternative actuators are described in U.S. application Ser. No. 16/826,052 files on Mar. 20, 2020 and included as Appendix A.

As shown in FIGS. 2A-2B, the tilt mechanism 124 can include an upper portion 124*a* and a lower portion 124*b*. The upper portion 124*a* can extend to a position disposed within (e.g., can have an upper terminal end disposed within) a lower end of the upper pole portion 128. The lower portion 124*b* can extend to a position disposed within (e.g., have a lower terminal end disposed within) an upper end of the lower pole portion 132. The tilt mechanism 124 can include a pivot axis 124*c*. The pivot axis 124*c* can be located between an upper terminal end of the upper portion 124*a* and a lower terminal end of the lower portion 124*b*. The pivot axis 124*c* can intersect, e.g., can extend through overlapping parts of the lower portion 124*b* and the upper portion 124*a*, e.g., through a part of the lower portion 124*b* adjacent to the upper terminal end thereof and through a part of the upper portion 124*a* adjacent to the lower terminal end thereof. The upper portion 124*a* can be pivotable with respect to the lower portion 124*b* about the pivot axis 124*c*. The pivot axis 124*c* can include a pin or axle and each of the upper and lower portions 124*a*, 124*b* can include corresponding flanges and apertures for receiving the pin in a pivotal manner. One of the upper and lower portion 124*a*, 124*b* can have a forked configuration including two adjacent projections configured to receive a projection of the other of the upper and lower portions 124*a*, 124*b* between the adjacent projections of the forked portion. The upper pole portion 128 can be coupled with the lower pole portion 132 by the tilt mechanism 124.

The lower hub 116 can be disposed over the central pole 120. The central pole 120 can be disposed within a central aperture 116*a* of the lower hub 116. The central aperture 116*a* can be sized to receive the central pole 120, with the lower hub 116 slideable over the central pole 120. FIG. 2A shows the lower hub 116 located at the tilt mechanism 124 and FIG. 2B illustrates the lower hub 116 positioned below the tilt mechanism 124. The upright pole 120 can include a stop 228. The stop 228 can be a transverse projection from the upright pole 120. The stop 228 can be located on the upper pole portion 128. The stop 228 can be located just above the tilt mechanism 124 or otherwise form a part of the tilt mechanism 124. The stop 228 can limit the uppermost position lower hub 116 to align with the tilt mechanism 124. As such, the stop 228 can be located to contact an upper edge of the lower hub 116 or an edge or ledge of the hub 116 when a portion of the hub overlaps the pivot axis 124*c*. For example, stop 228 could come to rest within a portion of the lower hub 116 between the upper edge and lower edge thereof. The stop 228 could be located adjacent to the upper portion 124*a* or the lower portion 124*b* of the tilt mechanism 124, e.g., on the lower pole portion 132 adjacent to the lower portion 124*b* of the tilt mechanism 124.

FIGS. 3-7 further illustrate one embodiment of the lower hub 116. The lower hub 116 can include plurality of outwardly extending projections 212. The projections 212 can be disposed around, e.g., circumferentially spaced around, an outer periphery of an outer portion 214 of the lower hub 116. The projections 212 can be spaced by corresponding recesses 213. The recesses 213 are configured to pivotably receive the struts 108 of the umbrella 100. Inner ends of the struts 108 opposite the outer ends (which are coupled to the ribs 104) are pivotally mounted within the recesses 213.

The lower hub 116 can include an inner portion 218 in addition to the outer portion 214. The outer portion 214 can be disposable about the upright pole 120 and over the tilt mechanism 124. The inner portion 218 can be disposable at least partially within the outer portion 214 and can be moved to various positions over the upright pole 120, e.g., over the lower portion 132 and/or the upper portion 128. As discussed further below, the inner portion 218 of the lower hub 116 can come to rest in an elevated position at which the inner portion 218 is disposed over the lower portion 132 of the upright pole 120. In some embodiments, the inner portion 218 of the lower hub 116 can come to rest in an elevated position at which the inner portion 218 is disposed over the upper portion 128 of the upright pole 120.

FIGS. 4 and 6A-7 show that the inner portion 218 can include an outer surface 218*a*. The outer surface 218*a* can comprise an outwardly curved or convex surface, e.g., a spherical surface. The outer surface 218*a* can extend around at least a portion of an outer circumference of the inner portion 218. The inner portion 218 can include a pivot structure, e.g., including a pivot shaft and/or one, two, or more than two pivot projections 218*b*. The pivot projections 218*b* can extend or project outwardly from the outer surface 218*a*. The pivot projections 218*b* can comprise curved, e.g., generally cylindrical members. The pivot projections 218*b* can be aligned with each other on opposite sides of the outer surface 218*a* along a pivot axis, e.g., spaced 180 degrees apart from each other. The inner portion 218 can include an upper edge 218*c*, sometimes called an upper rim 218*c*. The upper rim 218*c* can extend around at least a portion of an upper end of the outer surface 218*a*. The upper rim 218*c* can include an angled edge portion, sometimes called an angled rim portion 218*d*. The angled rim portion 218*d* can be at an angle with the rest of the upper rim 218*c*. The inner portion 218 can include a bottom edge 218*e*, sometimes called a bottom rim 218*e*. The bottom rim 218*e* can extend a circumference of the outer surface 218*a*. The bottom rim 218*e* can be located on an opposite side of the pivot projections 218*b* from the upper rim 218*c*. The inner portion 218 can include a central aperture 218*f*. The central aperture 218*f* can be sized to receive the central pole 120.

Figure 3:
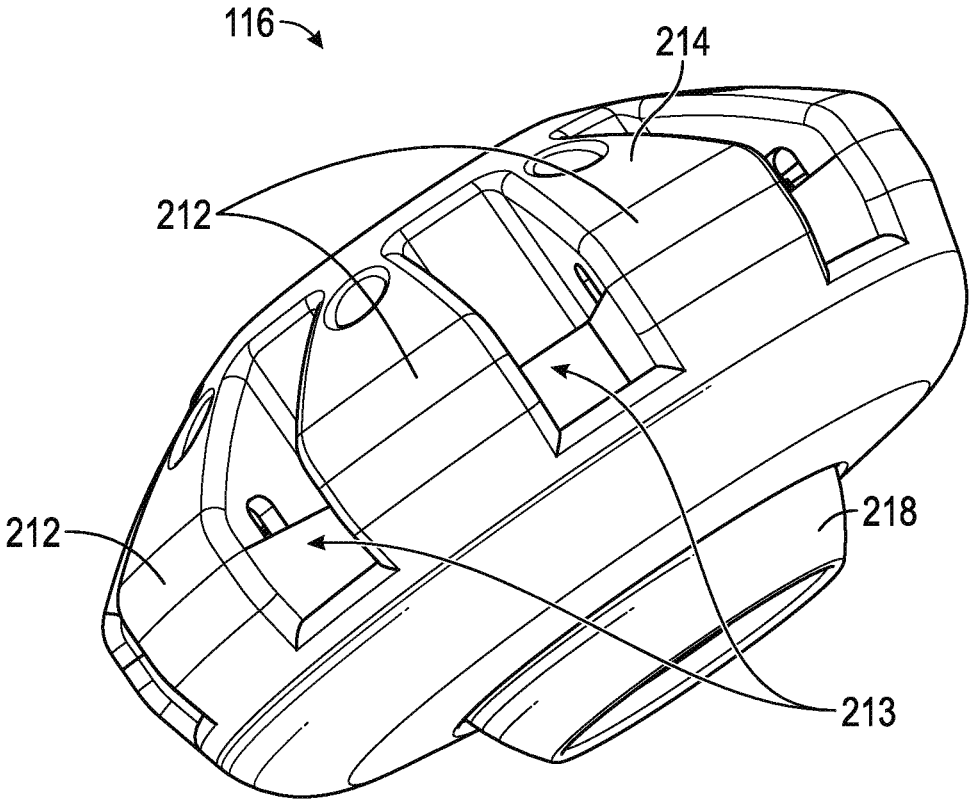
FIG. 3 is a perspective view of the lower hub having an inner portion configured to move along an umbrella pole and an outer portion pivotable relative to the inner portion.
Figure 4:
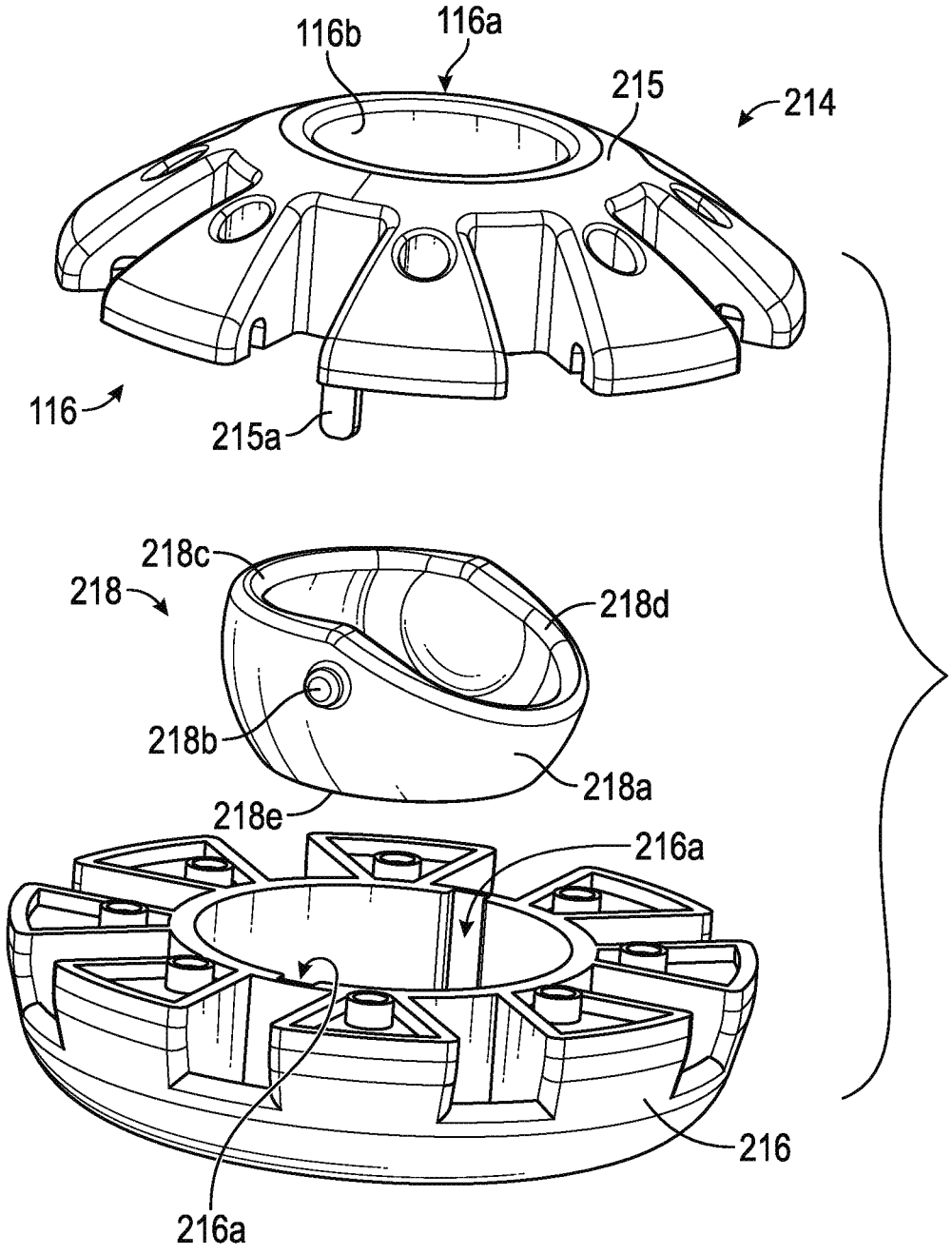
FIG. 4 is an exploded view of the lower hub of FIG. 3.
Figure 5:
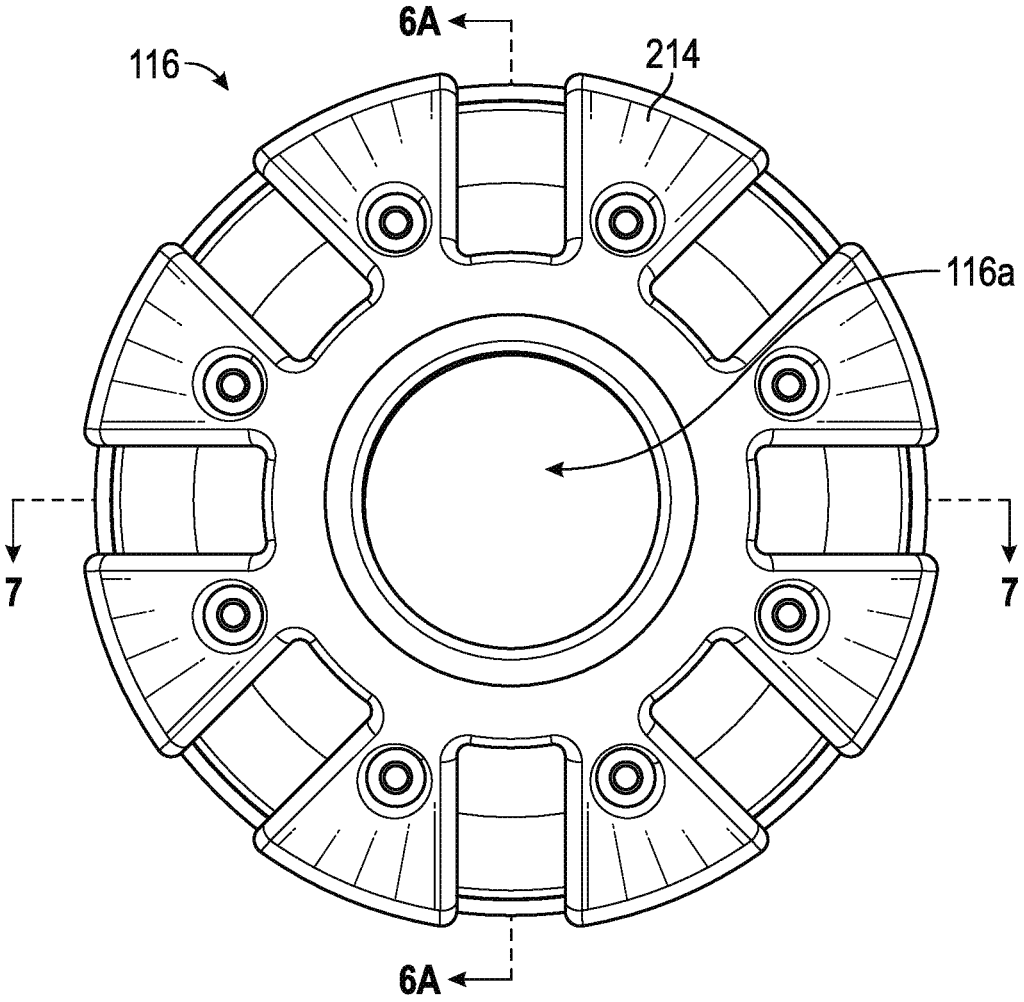
FIG. 5 is a top view of the lower hub of FIG. 3.

The outer portion 214 has a multi-part construction in some embodiments which facilitates assembly. For example, the outer portion 214 can comprise an upper member 215 and a lower member 216. The upper member 215 can be coupled together with the lower member 215 to form the outer portion 214. FIGS. 3 and 4 show that the projections 212 and the recesses 213 can be located partly on the upper member 215 and partly on the lower member 216. In other embodiments, the projections 212 and the recesses 213 could be located entirely on the projection 212 or entirely on the recesses 213. The upper member 215 and/or the lower member 216 can include one or more alignment and/or engagement features for assembling together the upper member 215 with the lower member 216.

The outer portion 214 can include the central aperture 116*a*. The central aperture 116*a* can include an inner wall 116*b*. The inner wall 116*b* can match the perimeter of the central pole 120, e.g., be generally cylindrical if the central pole 120 has a circular outer surface as viewed in transverse cross-section. At least a portion of the inner portion 218, e.g., an upper portion thereof, can be disposed within the central aperture 116*a* and generally aligned with the inner wall 116*b*. The central aperture 116*a* can include a lower edge 116*c*, sometimes called a lower rim 116*c*. The lower rim 116*c* can have a smaller radius than a radius of the inner wall 116*b* spaced apart from the lower rim 116*c*. The lower rim 116*c* can extend upward from the location where the central aperture 116*a* meets the bottom surface of the outer portion 214 and can include a generally concave or concave, spherical surface disposed along this upward extent. The central aperture to 116*a* can include an upper edge 116*d*, sometimes called an upper rim 116*d*. The upper rim 116*d* can extend downward from the location where the central aperture 116*a* meets the top surface of the outer portion 214. The upper rim 116*d* can be cylindrical and in some embodiments can have a smaller diameter than the inner wall 116*b*. The inner wall 116*b* can be located between the lower rim 116*c* and the upper rim 116*d*. A diameter of the upper rim 116*d* can be sized to receive, e.g., can be sized to slide over or translate along, the upright pole 120 and/or the tilt mechanism 124.

The inner wall 116*b* can include one, two or more than two recesses or channels 216*a*. The channels 216*a* can be recessed within the inner wall 116*b*. The channels 216*a* can extend parallel with a longitudinal axis of the central aperture 116*a*. The channels 216*a* can located around the inner wall 116*b* to correspond with position of the pivot projections 218*b* of the inner portion 218 when the lower hub 116 is assembled. The channels 216*a* can have straight circumferentially spaced edges. The channels 216*a* can have a radial surface spaced away from the central aperture 116*a*. The channels 216*a* can have a depth between the inner wall 116*b* and the radial surface that is at least as great as the length of the pivot projections 218*b* of the inner portion 218. The channels 216*a* can include a semi-circular (or other arcuate) end surface. An arcuate (e.g., semi-circular) end surface facilitates the pivoting of the outer portion 214 relative to the inner portion 218 as shown for example in FIGS. 6A and 6B.

Figure 6A:
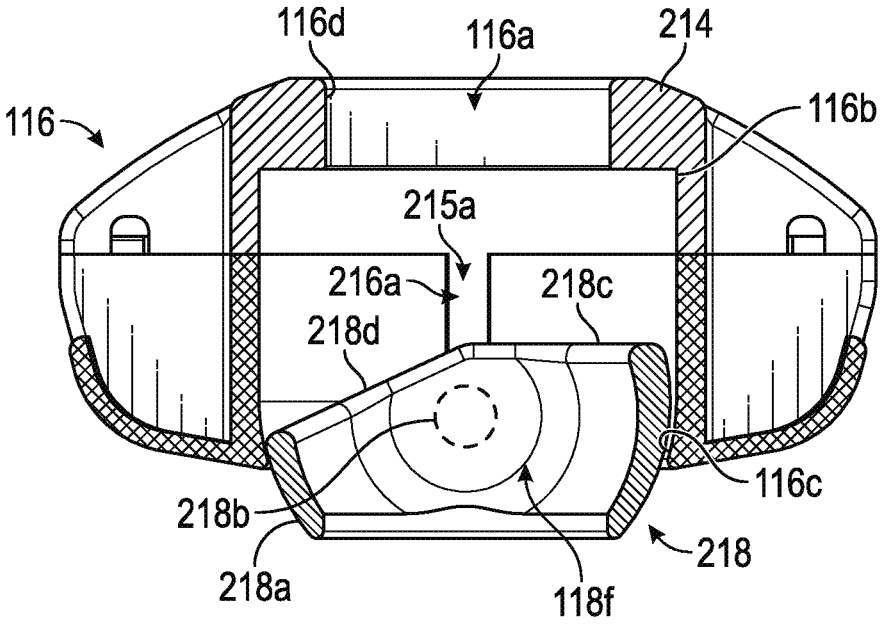
FIG. 6A is a cross-sectional view of the lower hub of FIG. 3 taken at the section plane 6A-6A seen in FIG. 5 showing a junction between the inner portion and the outer portion in an aligned configuration.
Figure 6B:
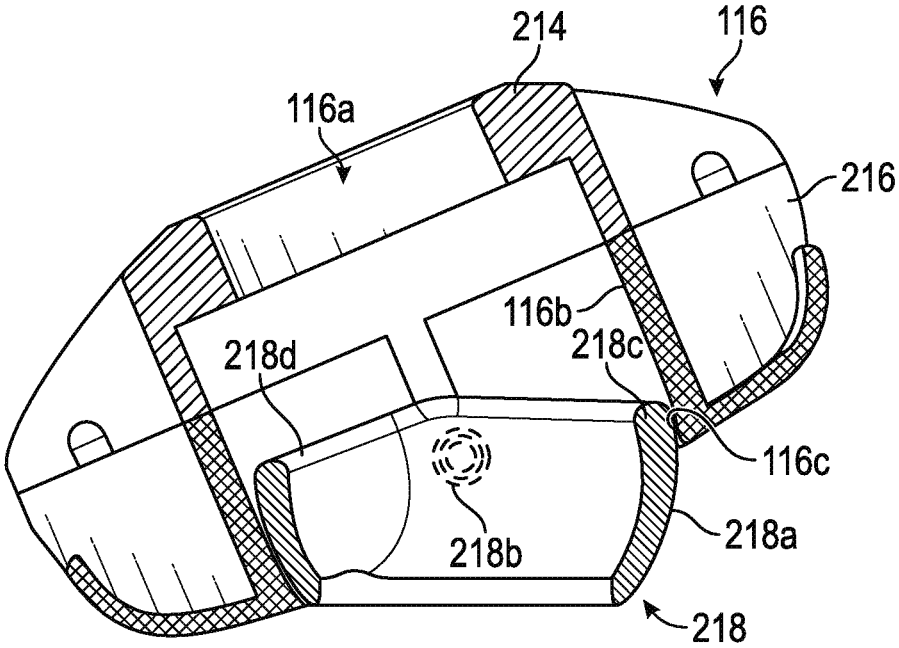
FIG. 6B is a cross-sectional view of the lower hub of FIG. 3 taken at the section plane 6B-6B seen in FIG. 5 showing the junction between the inner portion and the outer portion in a second configuration, the second configuration being tilted compared to the aligned configuration of FIG. 6A.
Figure 7:
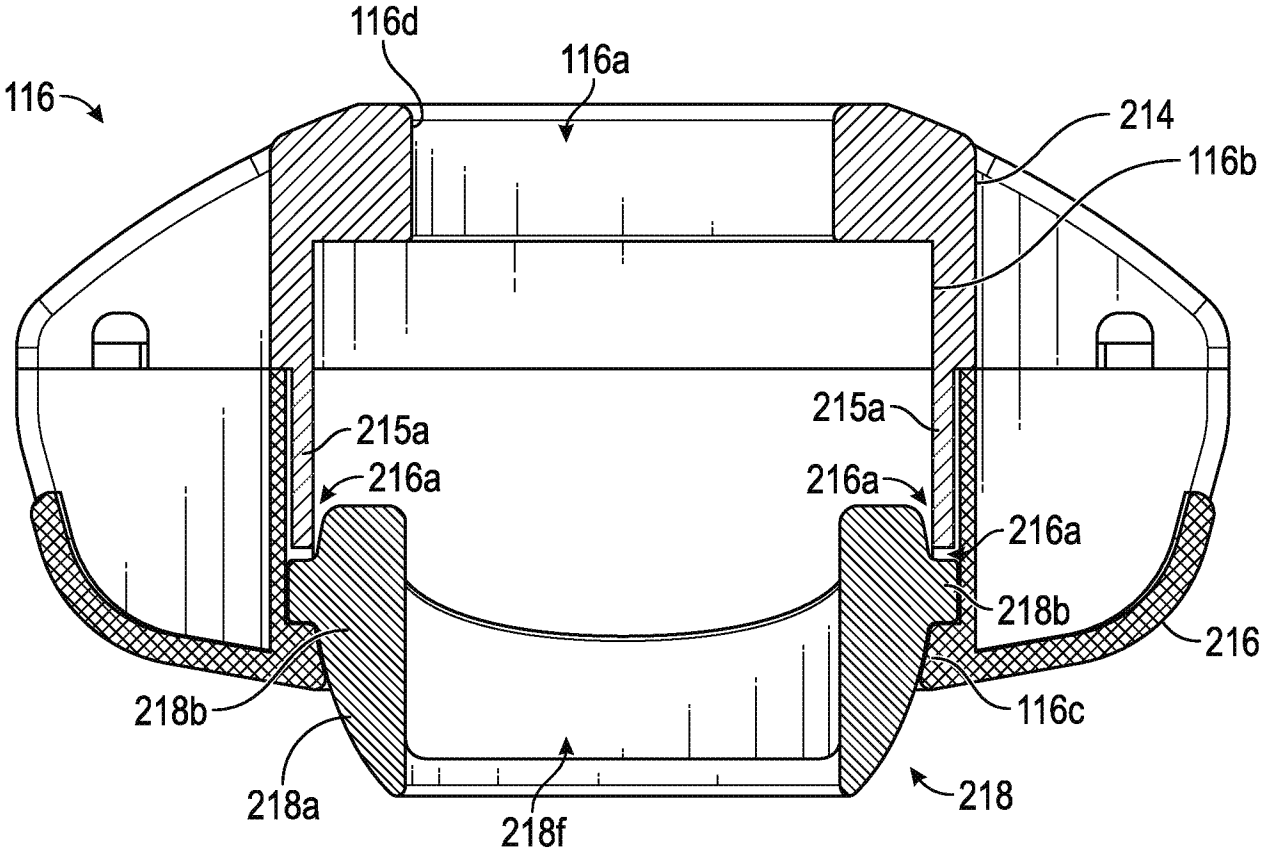
FIG. 7 is a cross-sectional view of the lower hub of FIG. 3 taken at the section plane 7-7 seen in FIG. 5.

The upper member 215 can include one or more trapping members or projections 215*a*. When the upper member 215 is assembled to the lower member 216, the projections 215*a* can extend across an interface between the upper member 215 and the lower member 216. The projections 215*a* can extend parallel with the longitudinal axis of the central aperture 116*a*. The projections 215*a* can be sized and aligned to be received within at least a portion of the channels 216*a*. The projections 215*a* can have an arcuate (e.g., semi-circular) end surface to facilitate pivoting of the outer portion 214 relative to the inner portion 218 as shown in FIGS. 6A and 6B.

The inner portion 218 can be coupled with the lower member 216. The inner portion 218 can be inserted within the lower member 216. The outer surface 218*a* can be engaged with the lower rim 116*c* to support the inner portion 218 within the outer portion 214. The lower rim 116*c* can match the contours of the outer surface 218*a*. Inserting the inner portion 218 can include inserting the pivot projections 218*b* into the corresponding channels 216*a*. After assembling the inner portion 218 with in the lower member 216, the upper member 215 can be assembled with the lower member 216. The projections 215*a* can be advanced within the corresponding channels 216*a*. The projections 215*a* can function to seat the pivot projections 218*b* within the channels 216*a*. The projections 215*a* can secure the inner portion 218 within the central aperture 116*a*. The projections 215*a* can limit translation of the pivot projections 218*b* within the channels 216*a*. The inner portion 218 can be pivotable within the central aperture 116*a*, as shown in FIGS. 6A-6B. FIG. 6B shows the second configuration of the lower hub 116.

Figure 8:
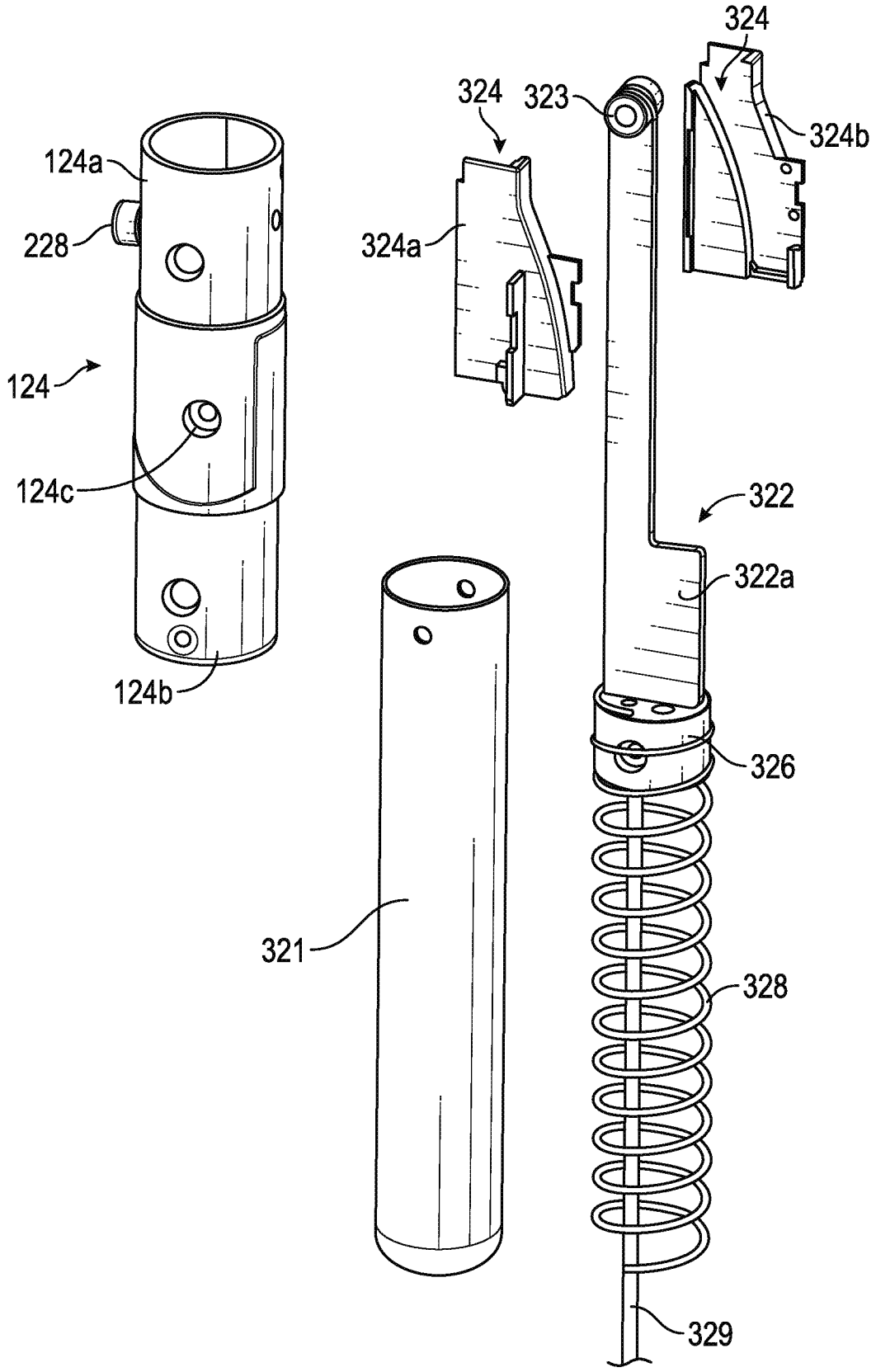
FIG. 8 is a partially exploded view of certain components of one implementation of a tilt mechanism.

As shown in FIG. 8, the tilt mechanism 124 can further include a sleeve 321. The sleeve 321 can be an inner portion of the lower pole portion 132 or a separate component within the lower pole portion 132. The sleeve 321 can be a generally cylindrical member having a hollow space therethrough. The tilt mechanism 124 can include a driver 322. The driver 322 can include a base 322*a* and an elongate portion having an end 323 extending from the base 322*a*. The base 322*a* can comprise a wider part of the driver 322 elongate portion having the end 323. The driver also has a projection that couples with the tension member 329. The end 323 can include one or more rollers.

The tilt mechanism 124 can include a spring 328. The spring 328 can be a coiled spring. The tilt mechanism 124 can include a base member 326. The base member 326 can be generally shaped as a cylindrical block. The base member 326 can couple with an end of the driver 322 opposite the end 323. The base member 326 can be disposable within or coupled with the spring 328. The tilt mechanism 124 can include a tension member 329. The tension member 329 can couple with the driver 322 through the base member 326 or directly with the driver 322. The base 322*a* of the driver 322 can include a projection that couples with the base member 326. The tension member 329 can couple with a link or pin connected with the driver 322. The tension member 329 can include a loop or hook that coupled with the link or pin. The tension member 329 can also loop through an aperture in the base 322*a*.

The tilt mechanism 124 can include a guide track or channel 324. The channel 324 can be formed in a first channel member 324*a* and a second channel member 324*b*. The first channel member 324*a* can cooperate with the second channel member 324*b* to form the channel 324. Alternatively, a single channel member can be employed with the channel member 324*b* disposed therethrough. The channel 324 can include a ramped surface.

The assembly of the tilt mechanism 124 is further illustrated as in FIGS. 9A and 9B. The sleeve 321 can be disposed about the spring 328 and/or the base member 326. The driver 322 (e.g., the base 322*a*) can be at least partially retractable within the sleeve 321. The sleeve 321 can be disposed within the lower portion 124*b* and/or the lower pole portion 132. The tension member 329 can be disposed within the lower pole portion 132. The channel 324 (e.g., defined in part by each of the channel members 324*a*, 324*b*) can be disposed in the upper portion 124*a* and/or the upper pole portion 128. The elongate portion of the driver 322 having the end 323 can extend across the interface between the upper portion 124*a* and the lower portion 124*b*. The end 323 can be disposed within the channel 324 on an opposite side of the pivot axis 124*c* from the spring 328. The rollers (or other movement enhancing devices or runners) coupled with or disposed on the end 323 can be engaged with walls within the channel 324.

The lower hub 116 can be raised to align with the tile mechanism 124, corresponding to an open configuration of the umbrella canopy. A cord 138 can extend through a channel within the tilt mechanism 124 and pass through the lower pole portion 132 and the upper pole portion 128 and extend over the pulley of the central pole 120 and return to couple with the lower hub 116. The cord 138 can be used to open and close the umbrella canopy 102 by raising and lowering the lower hub 116. The cord 138 can be coupled at an opposite end with an open/close mechanism, e.g., with a shaft or spool coupled with the crank handle 137.

In the raised position of the lower hub 116, the lower hub 116 can be aligned with the pivot axis 124*c*. In certain implementations, the pivot axis 124*c* can be a generally aligned with the axis of the inner projections 218*b*. In certain implementations, the tilt axis of the lower hub 116 can be located (i.e., either above or below) within ½", 1", or 2" of the pivot axis 124*c*. In certain implementations, the inner member 218 can be aligned with the pivot axis 124*c*.

In the second configuration shown in FIG. 9B, the upper pole portion 128 is tilted at an angle relative to the lower pole portion 132 by the tilt mechanism 124. The tilting can be actuated by the driver 322 and the channel 324. The driver 322 can be shifted downward (e.g., by a force on the tension member 329) with the first end 323 moved from a first raised position in the channel 324, to a second lowered position within the channel 324. Due to the ramped surface of the channel 324, the upper portion 124*a* and the upper pole portion 128 can pivot about the pivot axis 124*c* relative to the lower portion 124*b* and to the lower pole portion 132.

In the second configuration, the outer portion 214 of the lower hub 116 can be pivoted relative to the inner portion 218. The pivoting can occur on the tilt axis defined by the inner protrusions 218*b* within the channels 216*a*. Engagement of the outer surface 218*a* with the inner surface 116*b* can stabilize and steady the tilting motion of the tilt mechanism 124. In certain implementations, the outer surface 218*a* can be engaged with the lower rim 116*c* continuously in both the first and second configurations. Pivoting of the upper portion 124*a* and the upper pole portion 128 is further facilitated by the angled rim portion 218*d*. The angled rim portion 218*d* can accommodate a shifted position of the upper pole portion 128 within the central aperture 218*f*. Without the angled rim portion 218*d*, the upper pole portion 128 would interfere with the upper rim 218*c*.

The downward movement of the driver 322 can compress the spring 328. The spring 328 can store strain energy to bias the driver 322 into the upper position with the end 323 biased into the first position within the channel 324 corresponding to the second configuration of the umbrella 100. The driver 322 can be movable by a force applied to the tension member 329 by an actuator, such as the actuator 140. The actuator can be configured for moving the umbrella between the first and second configurations. Upward movement of the driver 322 can return the tilt mechanism 124 to the first configuration.

FIGS. 10-23C illustrate additional details of a slideable collar actuator 140. The slideable collar actuator 140 can include a collar 410. The collar 410 can be a generally cylindrical member having a first end 412 and a second end 418. An outer surface 411 can extend from the first end 412 to the second end 418. The outer surface can have any desirable shape, such as a shape configured for gripping by a hand.

The collar 410 can include an inner shelf 414. The inner shelf 414 can extend around an inner circumference of the collar 410. The inner shelf 414 can separate an upper interior wall having a greater inner diameter from a lower interior wall having a lesser inner diameter. The inner shelf 414 can comprise a stepped surface. One or more upright ribs 413 can extend inwardly from the upper interior wall. The upright ribs 413 can extend parallel with a longitudinal axis of the collar 410.

The collar 410 can include one or more inward projections 416. The inward projections 416 can be spaced around a circumference of the lower interior wall. The inward projections 416 can project radially inwardly. The collar 410 can include one or more recesses 415. The recesses 415 can be located in the portion of the collar 410 corresponding to the lower interior wall. The recesses 415 can include greater inner diameters than the inner diameter of the lower interior wall. The recesses 415 can be have a concave curvature.

The slideable collar actuator 140 can include a locking sleeve 420. The locking sleeve 420 can be generally cylindrical in shape. The locking sleeve 420 can include a first end 422 and a second end 428 with an outer surface 421 extending therebetween. The first end 422 can include a radially outwardly extending flange 422*a*. The flange 422*a* can include a chamfered or rounded edge. The first end 422 can include one or more projections separated by one or more slots 421*a* in the outer surface 421. The locking sleeve 420 can include one or more apertures 429. The apertures 429 can receive a pin therein. The pin can extend across the outer surface 421.

The outer surface 421 can further include one or more outer projections 425. The outer projections can include a projection head 425*a*. In a first position, the projection heads 425*a* can extend radially outwardly of the outer surface 421 and radially inwardly of the outer surface 421. The outer projections 425 can include a cantilevered member 425*b* extending from the first end 422 towards to the second end 428. The projections heads 425*a* can be located on the cantilevered members 425*b*. The cantilevered members 425*b* can bias the projections heads 425*a* into the first position. The outer projections 425 can be spaced between the slots 421*a*.

The slideable collar actuator 140 can include a pole shield 430. The pole shield 430 can generally form a cylindrical member. The pole shield 430 can include a first end 432 and a second end 438. An outer surface 431 can extend from the first end 432 to the second end 438. The first end 432 can include a lip 432*a*. The lip 432*a* can extend around a circumference of the first end 432. The lip 432*a* can project radially outwardly relative to the outer surface 431. The first end 432 can include one or more recesses 433. The recesses 433 can be located at spaced intervals around the first end 432. The recesses 433 can extend from an upper edge or upper rim of the first end 432 towards the second end 438. The first end 432 can include slots 435. The slots 435 can be internal slots. The slots 435 can extend radially inwardly from the outer surface 431 of the pole shield 430. The slots 435 can be surrounded on all sides around the slots 435 such they are not open at the upper edge of the first end 432. The internal slots 435 can be space at intervals around the first end 432. The slots 435 can be oriented in a transverse direction, relative to a longitudinal axis of the pole shield 430. A central aperture of the pole shield 430 can receive the central pole 120.

In an assembled configuration of the slideable collar actuator 140, the locking sleeve 420 can be disposed over the lower pole portion 132. The locking sleeve 420 can be coupled with the tension member 329. The locking sleeve 420 can be coupled with the tension member 329 be a pin 501. The pin 501 can be disposed through one or more slots 132*b* in the lower pole portion 132. The pin 501 can be coupled within or extend through the apertures 429 of the locking sleeve 420.

The collar 410 can be disposed over the locking sleeve 420 and the lower pole portion 132. The collar 410 can include a ring lid 440. The ring lid 440 can comprise a circumferential member that extends around the lower pole portion 132. The ring lid 440 can be coupled with the first end 412 of the collar 410. The pole shield 430 can be assembled over the lower pole portion 132. The lower pole portion 132 can include one or more indentations or recesses 132*a*. The first end 432 of the pole shield 430 can be coupled with the second end 418 of the collar 410. The inward projections 416 can be coupled within the slots 435 to secure the pole shield 430 with the collar 410. The second end 438 of the pole shield 430 can be disposed within a housing 136*a* of the open/close mechanism 136.

The assembly of the collar 410, the locking sleeve 420 and the pole shield 430 can be slideable on the lower pole portion 132 to actuate the tile mechanism 124 by moving the tension member 329. In a raised configuration of the slideable collar actuator 140, as shown in FIG. 23A, the outer surface 431 of the pole shield 430 can be disposed over the recesses 132*a*. The flange 422*a* of the locking sleeve 420 can engaged with the inner shelf 414 of the collar 410. The projections heads 425*a* can be disposed within the recesses 415. The first end 422 of the locking sleeve 420 can be spaced from the ring lid 440 by an inner spacing 502. The pin 501 and the tension member 329 can be in a raised position within the slots 132*b* (corresponding to the second configuration of the tilt mechanism 124).

Figure 23C:
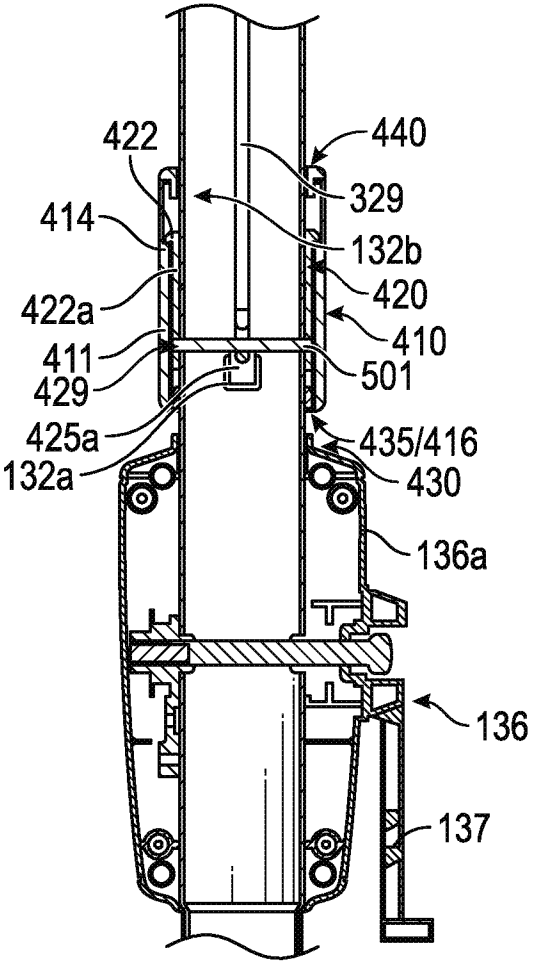
FIG. 23C is a cross-sectional view of the crank mechanism and a slideable collar actuator of FIGS. 10-11 taken along the line 23C-23C in FIG. 11.
Figure 23B:
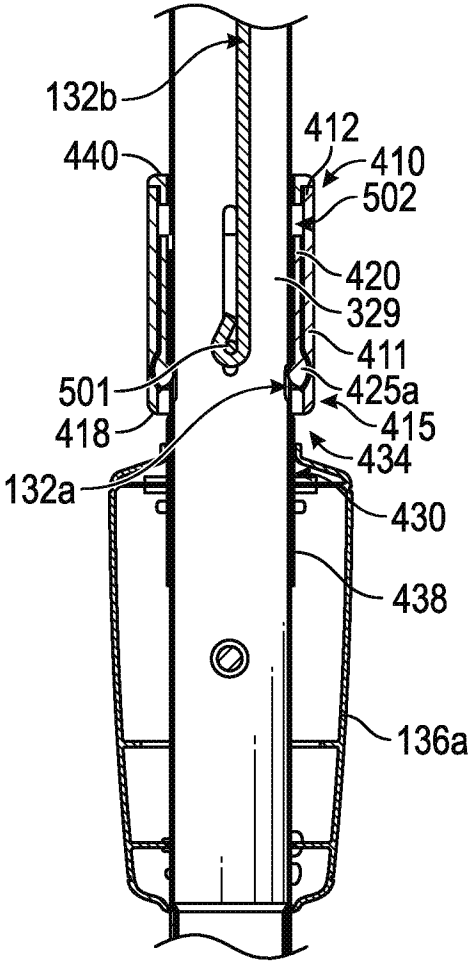
FIG. 23B is a cross-sectional view of the crank mechanism and a slideable collar actuator of FIGS. 10-11 taken along the line 23B-23B in FIG. 10.
Figure 23A:
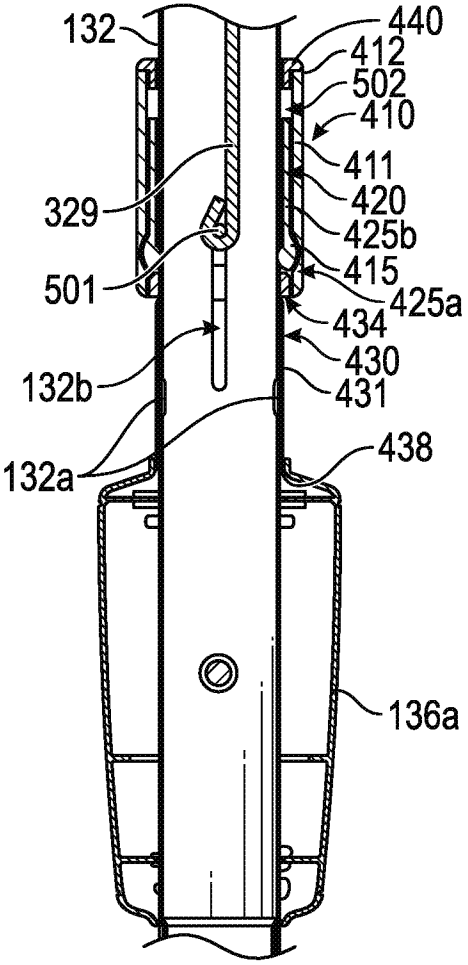
FIG. 23A is a cross-section view of the crank mechanism and the slideable collar actuator of FIGS. 10-11 taken along the line 23A-23A in FIG. 10.
Figure 23D:
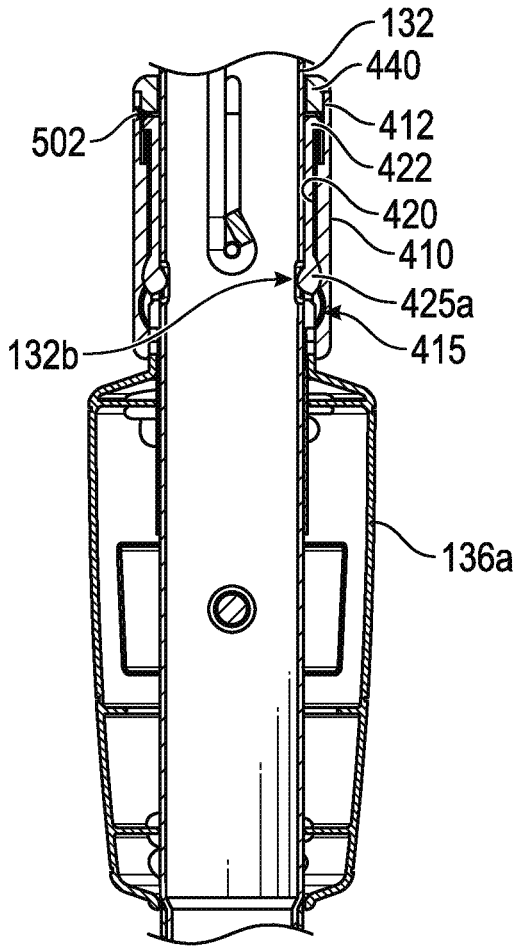
FIG. 23D shows FIG. 23B with the slideable collar actuator lowered to flex protrusions on the locking sleeve inwardly.

In a lowered configuration of the slideable collar actuator 140, as shown in FIGS. 23B-23D, collar 410 can be lowered on the lower pole portion 132. The slideable collar actuator 140 can be moved into the lowered configuration by a user grasping the collar 410 and shifting it downwardly. The outer surface 431 of the pole shield 430 can be lowered (e.g., into the housing 136*a*) to expose the recesses 132*a*. The projections heads 425*a* can be disposed within the recesses 132*a*. The collar 410 can be shifted downwards over the locking sleeve 420, relative to the position of the collar 410 on the locking sleeve 420 in the raised configuration. The recesses 415 can be lowered below the projections heads 425*a*. An inner wall of the collar 410 can deflect the cantilevered members 425*b* inwardly and press the projections heads 425*a* firmly into the recesses 415 to secure the locking ring 420 in the lowered configuration (corresponding to the second configuration of the tilt mechanism 124). The first end 422 of the locking sleeve 420 can be generally aligned with the first end 412 of the collar 410 (e.g., eliminating or shortening the inner spacing 502).

The slideable collar actuator 140 can be returned to the raised configuration by a user grasping the collar 410 and shifting it upwards. The locking sleeve 420 can be pulled upward with the collar 410 by the flange 422*a* engaged with the inner shelf 414. The projection heads 425*a* can be released from the recesses 132*a* by shifting the inner wall of the collar 410 upwardly. The projection heads 425*a* can deflect outwardly by the cantilevered members 425*b*. The projection heads 425*a* can be received within the recesses 415.

Figure 24:
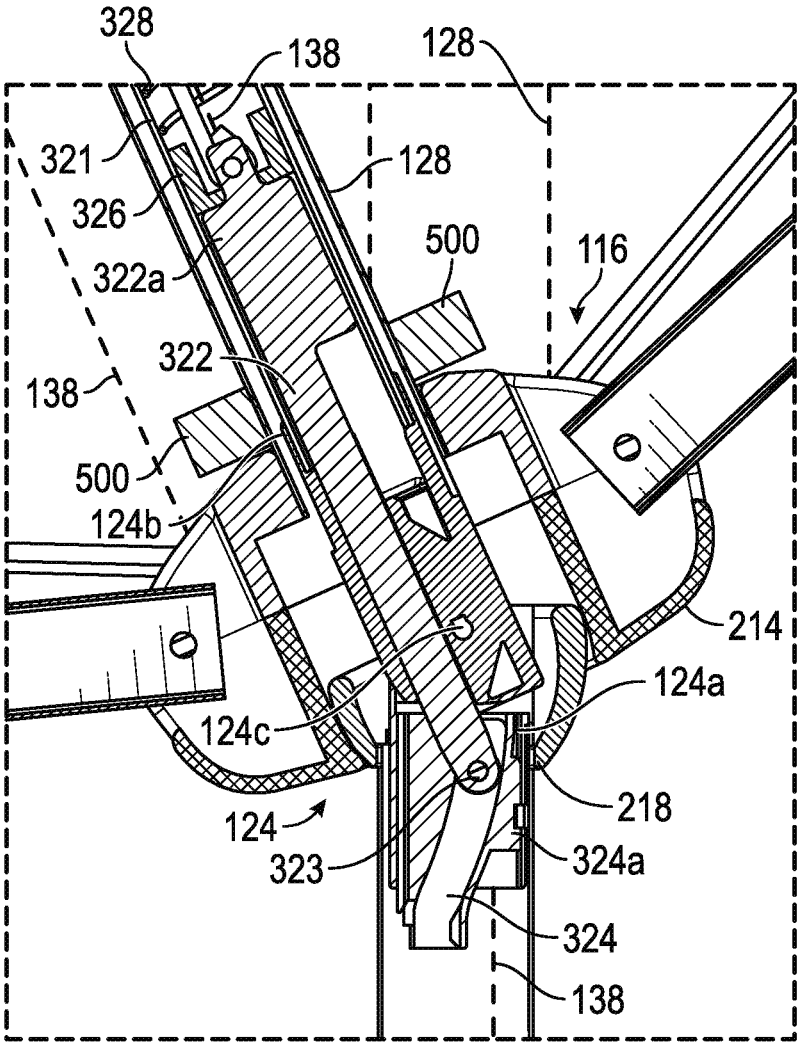
FIG. 24 shows an auto-tilt embodiment of the tilt mechanism operated by the crank mechanism.

In another embodiment shown in FIG. 24, the tilt mechanism 124 can be and auto-tilt mechanism, like that in U.S. Pat. No. 10,758,015, the entirety of which is hereby incorporated by reference for purposes of further description of the tilt mechanism in the auto-tilt arrangement. The tilt mechanism 124 can be oriented upside down from the implementation described above. The channel 324 can be located in the lower pole portion 132 and the spring 328 can be positioned within the upper pole portion 128. The driver 322 can be coupled with a catch or collar 500 extending outwardly of the central pole 120 through a slot (not shown). The lower pole portion 132 can be coupled with the open/close mechanism 136, including the crank 137 and a spool, by the cord 138. The cord 138 can pass through the central pole 120, over the pulley, and return to connect with the lower hub 116. Rotation of the crank 137 in a first direction can raise the lower hub 116 by winding the cord 138 on the spool (e.g., to open the canopy). Further rotation of the crank 137 can raise the lower hub 116 to engage with the catch 500 on the driver 322. Further rotation of the crank 137 can raise catch 500 that raises the driver 322 and the end 323 within the channel 324. The raising of the catch 500 and driver 322 can actuate the tilt mechanism 124 to move into the second configuration. The hub 116 can accommodate this tilting while located at the pivot 124*c* between the upper pole portion 128 and the lower pole portion 132.

Conditional language, such as "can," "could," "might," or "may," unless specifically stated otherwise, or otherwise understood within the context as used, is generally intended to convey that certain implementations include, while other implementations do not include, certain features, elements, and/or steps. Thus, such conditional language is not generally intended to imply that features, elements, and/or steps are in any way required for one or more implementations or that one or more implementations necessarily include logic for deciding, with or without user input or prompting, whether these features, elements, and/or steps are included or are to be performed in any particular implementation.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain implementations, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some implementations have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various implementations can be used in all other implementations set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular implementation. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred implementations and examples, it will be understood by those skilled in the art that the present inventions extend beyond the specifically disclosed implementations to other alternative implementations and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the implementations may be made and still fall within the scope of the inventions. It should be understood that various features and aspects of the disclosed implementations can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed implementations described above. The limitations in the claims are to be interpreted broadly based on the language employed in the claims and not limited to the examples described in the present specification or during the prosecution of the application, which examples are to be construed as non-exclusive.

What is claimed is:

1. An umbrella, comprising:

an upright pole comprising an upper pole portion and a lower pole portion;

a canopy assembly comprising a lower hub and a plurality of support members coupled with the lower hub; and a tilt mechanism comprising an actuator coupled with the lower pole portion, wherein the tilt mechanism is configured to adjust the upper pole portion from a first configuration in which the upper pole portion is aligned with the lower pole portion to a second configuration in which the upper pole portion is tilted relative to the lower pole portion;

wherein the lower hub is disposed at a tilt location of the upright pole when the upper pole portion is tilted relative to the lower pole portion and wherein at least a portion of a driver moveable within an upper portion of the tilt mechanism is disposed at or above a plane transverse to the upper pole portion, which plane intersects at least one support member of the plurality of support members at an axis of rotation of the at least one support member coupled with the lower hub when the upper pole portion is titled relative to the lower pole portion.

2. The umbrella of claim 1, wherein the driver comprises an end engaged within a channel such that moving the driver along an axis of the upright pole moves the end of the driver within the channel and tilts the upper pole portion between the first configuration and the second configuration.

3. The umbrella of claim 2, wherein the tilt mechanism further comprises a spring component configured to store strain energy when the driver is moved such that the tilt mechanism is biased to the first configuration.

4. The umbrella of claim 2, wherein the tilt mechanism comprises a sleeve disposed about the lower pole portion, the sleeve being coupled with a tension member disposed through the lower pole portion and being engaged with the driver such that moving the sleeve along the lower pole portion away from the canopy assembly moves the end of the driver within the channel and tilts the upper pole portion between the first configuration and the second configuration.

5. The umbrella of claim 4, wherein the tilt mechanism further comprises a locking ring for retaining the sleeve in a tilt position disposed away from the canopy assembly.

6. The umbrella of claim 4, further comprising a mechanism configured to open and close the canopy assembly that is separate from the tilt mechanism.

7. The umbrella of claim 2, wherein the tilt mechanism comprises a channel configured for routing a cord through the tilt mechanism between a spool and a pulley of an opening and closing mechanism.

8. The umbrella of claim 2, wherein the tilt mechanism comprises an opening and closing mechanism including a spool and a crank disposed on the lower pole portion and a cord extending over a pulley on the upper pole portion, an end of the cord engaged with the lower hub such that cranking the spool in a first direction raises the lower hub to open the canopy assembly and engages the lower hub with the driver, and further cranking in the first direction moves the end of the driver within the channel and tilts the upper pole portion between the first configuration and the second configuration.

9. The umbrella of claim 1, wherein the upper pole portion is tilted relative to the lower pole portion at a pivot axis disposed transverse to the lower pole portion, the lower hub being intersected by the pivot axis when the upper pole portion is tilted relative to the lower pole portion.

10. An umbrella comprising:

an upright pole comprising an upper pole portion and a lower pole portion;

a canopy assembly comprising a lower hub and a plurality of support members coupled with the lower hub; and a tilt mechanism comprising an actuator coupled with the lower pole portion, wherein the tilt mechanism is configured to adjust the upper pole portion from a first configuration in which the upper pole portion is aligned with the lower pole portion to a second configuration in which the upper pole portion is tilted relative to the lower pole portion;

wherein the lower hub is disposed at a tilt location of the upright pole when the upper pole portion is tilted relative to the lower pole portion, wherein the lower hub is jointed to permit a first portion to be aligned with the lower pole portion and a second portion to be tilted relative to the first portion such that the second portion can be aligned with an upper pole portion when the upper pole portion is angled relative to the lower pole portion.

11. The umbrella of claim 10, wherein first portion is pivotable about an axis relative to the second portion.

12. The umbrella of claim 11, wherein the second portion of the lower hub comprises an inner portion that has a spherical outer surface and the first portion of the lower hub comprises an outer portion that has an inner cavity with an inner wall configured to pivot over the spherical outer surface of the inner portion.

13. The umbrella of claim 12, wherein the inner portion of the lower hub comprises a plurality of circular projections disposed in a plurality of circular recesses disposed in the outer portion of the lower hub.

14. The umbrella of claim 13, wherein the plurality of circular recesses comprise an elongate slot comprising a semi-circular end surface.

15. The umbrella of claim 14, wherein the lower hub comprises a lower hub portion comprising the elongate slot and an upper hub portion comprising a plurality of trapping elements configured to trap the plurality of circular projections in the plurality of circular recesses.

16. An umbrella, comprising:

an upright pole comprising an upper pole portion and a lower pole portion;

a canopy assembly comprising an upper hub coupled with the upper pole portion, a lower hub, a plurality of support members coupling the upper hub with the lower hub, the lower hub comprising an inner portion disposed about the upright pole and an outer portion disposed about the inner portion;

a first mechanism for moving the lower hub along the upright pole between a lowered position corresponding to a closed configuration of the canopy assembly and a raised position corresponding to an open configuration of the canopy assembly; and a second mechanism comprising an actuator coupled with the lower pole portion, wherein the second mechanism is configured to adjust the upper pole portion from a first configuration in which the upper pole portion is aligned with the lower pole portion to a second configuration in which the upper pole portion is tilted relative to the lower pole portion;

wherein the lower hub is disposed at a pivot location of the upright pole when the upper pole portion is tilted relative to the lower pole portion and the outer portion of the lower hub is tilted relative to the inner portion of the lower hub, and wherein the outer portion of the lower hub is tilted relative to the inner portion of the lower hub when the upper pole portion is tilted relative to the lower pole portion.

17. The umbrella of claim 16, wherein a tilt mechanism comprising a lower coupler coupled with the lower pole portion, an upper coupler coupled with the upper pole portion, and a pivot axis disposed transverse to the lower pole portion, the lower hub being intersected by the pivot axis when the upper pole portion is tilted relative to the lower pole portion.

18. The umbrella of claim 16, wherein the inner portion of the lower hub comprises a spherical outer surface and the outer portion of the lower hub comprises an inner cavity with a spherical inner wall configured to pivot over the spherical outer surface of the inner portion.

19. The umbrella of claim 16, wherein the inner portion of the lower hub comprises a plurality of circular projections disposed in a plurality of circular recesses disposed in the outer portion of the lower hub.

20. The umbrella of claim 19, wherein the plurality of circular recesses comprise an elongate slot comprising a semi-circular end surface.

21. The umbrella of claim 20, wherein the lower hub comprises a lower hub portion comprising the elongate slot and an upper hub portion comprising a plurality of trapping elements configured to trap the plurality of circular projections in the plurality of circular recesses.

22. An umbrella, comprising:

an upright pole comprising an upper pole portion and a lower pole portion;

a canopy assembly comprising a lower hub and a plurality of support members coupled with the lower hub, the lower hub comprising an inner portion disposed about the upright pole and an outer portion disposed about the inner portion, the inner portion pivotably coupled with the outer portion; and a tilt mechanism comprising an actuator coupled with the lower pole portion, wherein the tilt mechanism is configured to adjust the upper pole portion from a first configuration in which the upper pole portion is aligned with the lower pole portion to a second configuration in which the upper pole portion is angled relative to the lower pole portion, the outer portion of the lower hub being angled relative to the inner portion of the lower hub when the upper pole portion is angled relative to the lower pole portion.

23. The umbrella of claim 22, wherein the inner portion of the lower hub comprises a spherical outer surface and the outer portion of the lower hub comprises an inner cavity with an inner wall moveable over the spherical outer surface of the inner portion.

24. The umbrella of claim 22, wherein the inner portion of the lower hub comprises a plurality of pivot projections disposed on opposite sides of the inner portion and disposed in a corresponding plurality of pivot recesses in the outer portion of the lower hub.

25. The umbrella of claim 24, wherein the plurality of pivot recesses comprise an elongate slot comprising an arcuate end surface.

26. The umbrella of claim 25, wherein the lower hub comprises a first hub portion comprising the elongate slot and a second hub portion comprising a plurality of trapping elements configured to trap the plurality of pivot projections in the plurality of pivot recesses.

27. The umbrella of claim 26, further comprising an opening and closing mechanism that is configured to operate independently of the tilt mechanism.

28. The umbrella of claim 27, wherein the umbrella comprises a stop member disposed on the upright pole configured to contact a top surface of the lower hub when the lower hub is aligned with a pivot axis of the tilt mechanism about which the tilt mechanism is configured to adjust the upper pole portion from the first configuration to the second configuration.

* * * * *